US006331844B1

(12) United States Patent
Okumura et al.

(10) Patent No.: US 6,331,844 B1
(45) Date of Patent: Dec. 18, 2001

(54) LIQUID CRYSTAL DISPLAY APPARATUS

(75) Inventors: Haruhiko Okumura, Fujisawa; Akira Kinno; Hisao Fujiwara, both of Yokohama; Goh Itoh, Tokyo; Norihiko Kamiura, Yokohama, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 08/868,733

(22) Filed: Jun. 4, 1997

(30) Foreign Application Priority Data

Jun. 11, 1996 (JP) ..... 8-149182

(51) Int. Cl.[7] ..... G09G 3/38

(52) U.S. Cl. ..... 345/87; 345/92; 345/100; 345/204; 345/205; 345/206; 345/211; 345/212

(58) Field of Search ..... 345/92, 100, 204, 345/205, 206, 211, 212, 90, 91, 97

(56) References Cited

U.S. PATENT DOCUMENTS

| | | | | |
|---|---|---|---|---|
| 4,302,751 | * | 11/1981 | Nakauchi et al. | 340/763 |
| 5,078,476 | * | 1/1992 | Shin | 359/48 |
| 5,111,195 | * | 5/1992 | Fukuoka et al. | 340/811 |
| 5,343,221 | * | 8/1994 | Arakawa et al. | 345/211 |
| 5,420,604 | * | 5/1995 | Scheffer et al. | 345/100 |
| 5,614,922 | * | 3/1997 | Kawaguchi et al. | 345/89 |
| 5,691,783 | * | 11/1997 | Numao et al. | 349/48 |
| 5,712,652 | * | 1/1998 | Sato et al. | 345/90 |
| 5,774,100 | * | 6/1998 | Aoki et al. | 345/87 |
| 5,844,535 | * | 12/1998 | Itoh et al. | 345/92 |
| 5,847,702 | * | 12/1998 | Jung | 345/211 |
| 5,854,617 | * | 12/1998 | Lee et al. | 345/102 |
| 5,870,075 | * | 2/1999 | Yamazaki et al. | 345/149 |
| 5,945,972 | * | 8/1999 | Okumura et al. | 345/98 |
| 5,956,006 | * | 9/1999 | Sato | 345/88 |
| 5,959,598 | * | 9/1999 | McKnight | 345/90 |
| 6,115,014 | * | 9/2000 | Aoki et al. | 345/88 |
| 6,115,021 | * | 9/2000 | Nonomura et al. | 345/101 |
| 6,127,995 | * | 10/2000 | Furuhashi et al. | 345/96 |

FOREIGN PATENT DOCUMENTS 8-335059 12/1996 (JP) .

* cited by examiner

*Primary Examiner*—Bipin Shalwala
*Assistant Examiner*—Vanel Frenel

(57) ABSTRACT

A liquid crystal display apparatus includes a substrate, a plurality of scanning lines extending substantially in parallel with each other in a row direction on the substrate, a plurality of signal lines extending substantially in parallel with each other in a column direction on the substrate, a signal line driver for supplying a pixel signal of current variables to each of the plurality of signal lines, a scanning line driver for selectively supplying a scanning signal to the plurality of scanning lines, and a plurality of pixels arranged on the substrate at intersections of the plurality of scanning lines and the plurality of signal lines, each of the plurality of pixels including a converter for receiving the pixel signal of current variables, which is supplied to the signal line, and converting the pixel signal into a voltage signal, and a liquid crystal cell to which the converted voltage signal is applied.

10 Claims, 15 Drawing Sheets

LIQUID CRYSTAL DISPLAY APPARATUS

BACKGROUND OF THE INVENTION

The present invention relates to a liquid crystal display apparatus whose power consumption is reduced.

In recent years, the power consumption of a liquid crystal display apparatus has been reduced by lowering the driving voltage or driving frequency. To further reduce the power consumption, a structure in which a memory is arranged for every pixel is proposed (Jpn. Pat. Appln. KOKAI Publication No. 58-196582 or 3-77922). With this technique employed for a still image, once display signals are transmitted to the respective pixels, the pixels may always be displayed with the signals held in the memories of the pixels. Theoretically, since only the power necessary for polarity inversion is consumed, the power consumption for the still image almost becomes "0".

However, along with the progress in multimedia, display of moving images has been increasingly required recently. In a moving image, image information sequentially changes at a high speed. For this reason, even memories are provided in units of pixels, signals held in the memories must be frequently rewritten. To frequently rewrite the held signals (pixel signals), a large power is consumed, as in prior arts.

In the above-described LCD with pixel memories, display signals obtained through switches SW are held in the pixel memories, and an image is displayed using the contents held in the memories. When this technique is to be applied to still image display, pixel signals are temporarily stored in the pixel memories. Unless the image changes, the memory contents need not be rewritten. Therefore, the driving frequency or static power consumption is expected to lower. However, for a moving image, the memory contents must be rewritten so no power consumption reduction effect can be expected, unlike still image display.

A demand has arisen for a low-power liquid crystal display apparatus capable of reducing the power consumption even in case of moving image display, and for portable equipment using the liquid crystal display apparatus as an image display device, minimizing waste of the battery, i.e., the main power supply of the equipment to prolong the battery driving time.

BRIEF SUMMARY OF THE INVENTION

It is an object of the present invention to provide a low power-consumption liquid crystal display apparatus capable of reducing the power consumption even in moving image display.

In order to achieve the above object, according to the first aspect of the present invention, there is provided a liquid crystal display apparatus comprising:

a substrate;

a plurality of scanning lines extending substantially in parallel with each other in a row direction on the substrate;

a plurality of signal lines extending substantially in parallel with each other in a column direction on the substrate;

a signal line driver for supplying a pixel signal of current variables to each of the plurality of signal lines;

a scanning line driver for selectively supplying a scanning signal to the plurality of scanning lines; and a plurality of pixels arranged on the substrate at intersections of the plurality of scanning lines and the plurality of signal lines, each of the plurality of pixels including conversion means for receiving the pixel signal of current variables, which is supplied to the signal line, and converting the pixel signal into a voltage signal, and a liquid crystal cell to which the converted voltage signal is applied.

The conversion means may include one of a capacitor and a resistor.

Preferably, the pixel further comprises first switch means inserted between the conversion means and a corresponding one of the plurality of signal lines and ON/OFF-controlled in accordance with the scanning signal of a corresponding one of the plurality of scanning lines.

Preferably, the pixel further comprises second switch means inserted between the conversion means and the liquid crystal cell, and a driving period of the liquid crystal cell is determined by ON/OFF of the second switch means.

The signal line driver may receive a digital voltage image signal and output the pixel signal of current variables under a predetermined voltage.

An output stage of the signal line driver may be constituted by an operational amplifier.

The signal line driver may receive an image signal of current variables and output the pixel signal of current variables.

In the liquid crystal display apparatus having the above arrangement, the pixel signal for driving the liquid crystal cell is output as a current signal and converted into a voltage signal in the pixel. The voltage of the signal line need not be changed, unlike a case wherein the pixel signal is a voltage signal. Since the amplitude of the pixel signal voltage for driving the signal line can be made to almost zero, almost no power is consumed to drive the signal line. Therefore, the power consumption can be reduced even in moving image display.

According to the second aspect of the present invention, there is provided a liquid crystal display apparatus comprising:

a substrate;

a plurality of scanning lines extending substantially in parallel with each other in a row direction on the substrate;

a plurality of signal lines extending substantially in parallel with each other in a column direction on the substrate;

a signal line driver for supplying a pixel signal to each of the plurality of signal lines;

a scanning line driver for selectively supplying a scanning signal to the plurality of scanning lines; and a plurality of pixels arranged on the substrate at intersections of the plurality of scanning lines and the plurality of signal lines, each of the plurality of pixels including holding means for holding the pixel signal supplied to the signal line, amplification means for amplifying the pixel signal, and a liquid crystal cell having a pixel electrode to which the amplified pixel signal is applied.

The amplification means may include an operational amplifier.

Preferably, the pixel further comprises first switch means for controlling energization to the operational amplifier in accordance with the scanning signal of a corresponding one of the plurality of scanning lines.

The amplification means may include a differential amplifier having two input terminals and two output terminals such that the pixel signals are input to the two input terminals from corresponding two of the plurality of signal lines.

Preferably, the pixel further comprises second switch means for selectively supplying two outputs from the differential amplifier to the pixel electrode of the liquid crystal cell.

Preferably, the pixel further comprises third switch means for controlling energization to the differential amplifier in accordance with the scanning signal of a corresponding one of the plurality of scanning lines.

Preferably, the pixel further comprises fourth switch means for selectively setting a potential of the pixel electrode of the liquid crystal cell at a reference potential.

Preferably, the pixel further comprises fifth switch means inserted between the amplification means and the pixel electrode of the liquid crystal cell and ON/OFF-controlled in accordance with the scanning signal of a corresponding one of this plurality of scanning lines.

Preferably, the pixel further comprises sixth switch means inserted between the amplification means and a corresponding one of the plurality of scanning lines and ON/OFF-controlled in accordance with the scanning signal of a corresponding one of the plurality of scanning lines.

According to this arrangement, each pixel has the amplification means for amplifying the pixel signal. The pixel signal is amplified by the amplification means and supplied to the liquid crystal cell to drive the liquid crystal cell. When the pixel signal is supplied as a voltage signal, the voltage of the pixel signal supplied to the signal line can be lowered. Therefore, the voltage for charging the signal line capacitor for transmitting the pixel signal lowers to result in a large reduction in power consumption for driving the signal line.

According to the third aspect of the present invention, there is provided a liquid crystal display apparatus comprising:

a signal processing section for outputting a difference signal between an nth frame image signal and an (n+1)th frame image signal;

a substrate;

a plurality of scanning lines extending substantially in parallel with each other in a row direction on the substrate;

a scanning line driver for selectively outputting a scanning signal to the plurality of scanning lines;

a plurality of signal lines extending substantially in parallel with each other in a column direction on the substrate;

a signal line driver for receiving the difference signal from the signal processing section and outputting a pixel signal based on the difference signal to the plurality of signal lines; and a plurality of pixels arranged on the substrate at intersections of the plurality of scanning lines and the plurality of signal lines, each of the plurality of pixels comprising pixel synthesizing means for adding a pixel signal corresponding to the nth frame image signal and the pixel signal based on the difference signal to synthesize a pixel signal corresponding to the (n+1)th frame image signal, and a liquid crystal cell having a pixel electrode to which the pixel signal corresponding to the (n+1)th frame image signal is supplied.

The pixel synthesizing means may comprise a first frame memory for holding the pixel signal corresponding to the nth frame image signal, and a first adder for adding the pixel signal corresponding to the nth frame image signal and the pixel signal based on the difference signal to synthesize the pixel signal corresponding to the (n+1)th frame image signal, supplying the synthesized signal to the pixel electrode of the liquid crystal cell, and supplying the pixel signal corresponding to the (n+1)th frame image signal to the first frame memory to update contents held in the first frame memory.

The pixel synthesizing means may include an operational amplifier for receiving the pixel signal based on the difference signal, and a capacitor connected between an input terminal and an output terminal of the operational amplifier for receiving the pixel signal based on the difference signal to hold the pixel signal corresponding to the (n+1)th frame image signal. The pixel synthesizing means may further comprise a switch inserted in parallel to the capacitor.

The pixel synthesizing means may include an A/D converter for receiving the pixel signal based on the difference signal, a second adder for receiving an output from the A/D converter, a D/A converter for receiving an output from the second adder and supplying an output to the pixel electrode of the liquid crystal cell, and a shift register for receiving the output from the second adder and supplying an output to the second adder.

The signal processing section preferably comprises a second frame memory for holding the nth frame image signal, a subtracter for receiving the (n+1)th frame image signal, calculating a difference between the (n+1)th frame image signal and the nth frame image signal held in the second frame memory, and outputting a subtraction result, and a third adder for adding the output from the subtracter and the nth frame image signal held in the second frame memory and outputting an addition result to the second frame memory to update contents held in the second frame memory.

According to the liquid crystal display apparatus of the third aspect, the difference signal between the current frame and the preceding frame is supplied to the signal line. In most moving images except scenes with quick motions and switching frames, the signal amplitude becomes about 0 [V], so the amplitude can be largely decreased. In addition, when the pixel signal has a current as a variable, the signal line driving voltage can be lowered.

Conventionally, the signal line is driven at an amplitude of 5 [V]. When difference signal driving or current driving is employed, as in the present invention, an image can be displayed at an amplitude as small as several hundred [mV]. since the power consumption is proportional to the square of the voltage, the power consumed in the signal line can be largely reduced to one-several tenth or one-several hundredth.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Prior to a description of the embodiments of the present invention, factors determining the power consumption of a liquid crystal display apparatus will be described.

Figure 1A:
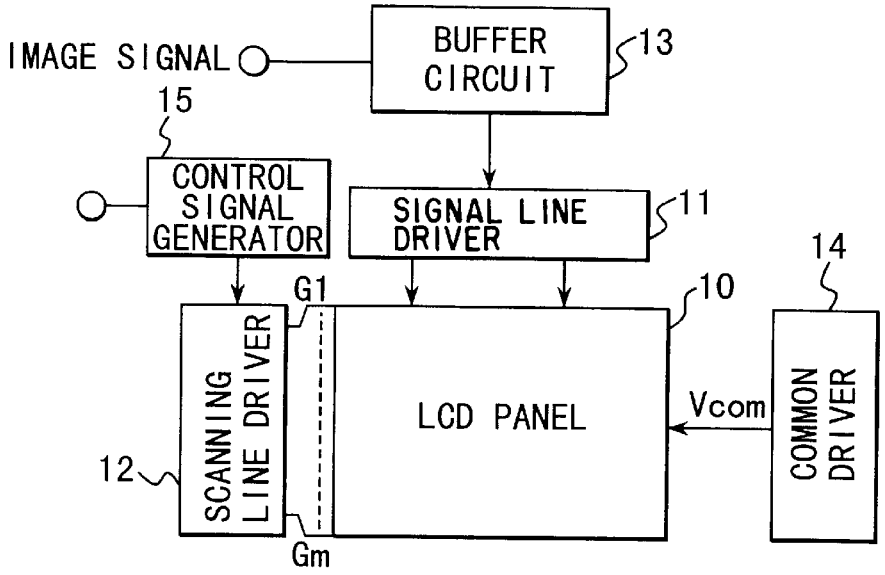
FIG. 1A PRIOR ART
FIGS. 1A and 1B are a block diagram showing the arrangement of a general liquid crystal display apparatus and a circuit diagram showing the arrangement of a liquid crystal display panel, respectively.
Figure 1B:
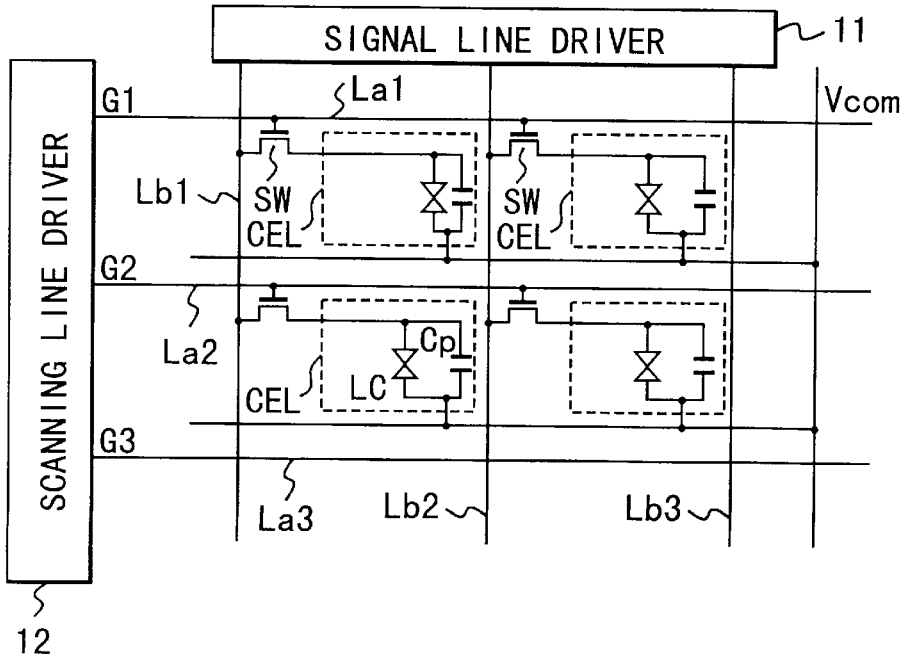
FIG. 1B PRIOR ART

FIGS. 1A and 1B show the schematic circuit arrangement of a liquid crystal display apparatus. As shown in FIG. 1A, the liquid crystal display apparatus comprises a liquid crystal display (LCD) panel 10, a signal line driver 11, a scanning line driver 12, a buffer circuit 13, a common driver 14, and a control signal generator 15.

As shown in FIG. 1B, the liquid crystal display panel 10 includes a plurality of small liquid crystal cells CEL arrayed in a matrix. A plurality of row scanning lines (gate signal lines) La1, La2, . . . , Lam extend in a row direction, and a plurality of signal lines Lb1, Lb2, . . . , Lbn extend in a column direction. Switches SW belonging to the respective liquid crystal cells CEL are driven by the corresponding row scanning lines. Pixel signals from the signal lines are supplied to the corresponding liquid crystal cells CEL so that images are displayed.

The liquid crystal cell CEL applied with a potential corresponding to the potential difference between the applied potential from the signal line and the potential of a common electrode VCOM, thus changing the pixel transparence in correspondence with the potential difference.

The common electrode potential VCOM is generated by the common driver 14. The control signal generator 15 generates various control signals necessary for a display operation to control the respective components such that a predetermined operation is performed.

The sampling switch SW belonging to each liquid crystal cell CEL is constituted by a TFT (thin film transistor). The gate terminal of the TFT is connected to a corresponding one of the row scanning lines La1 to Lam and ON/OFF-controlled by the signal of the row scanning line. The source-drain path of the TFT is connected between the corresponding one of the signal lines Lb1 to Lbn and the liquid crystal cell CEL so that an output from the signal line driver 11 is supplied to the liquid crystal cell CEL.

The gate line driver 12 sequentially supplies driving signals to the row scanning lines La1 to Lam to drive and control the switches SW (TFTs) of the liquid crystal cells in units of rows.

In this arrangement, the gate line driver 12 sequentially generates gate line driving signals G1 to Gm for a period when all the row scanning lines La1 to Lam extending in the vertical direction are scanned. The output terminals for the gate line driving signals G1 to Gm are connected to the corresponding row scanning lines La1 to Lam so that the switches SW of the liquid crystal cells connected to the row scanning lines on which the gate line driving signals are generated are ON/OFF-controlled. The row scanning lines are sequentially scanned by the gate line driver 12 in this manner.

An image signal is supplied to the signal line driver 11 via the buffer circuit 13. As the row scanning lines are scanned, the signal line driver 11 outputs pixel signals for the respective pixels of the row which is being scanned. The pixel signals are output to the signal lines Lb1 to Lbn arranged in correspondence with the pixels.

Factors which determine the power consumption of drivers (module circuits) in the liquid crystal display apparatus will be examined next. In the following examination, the power consumption due to a DC bias current is not included in the power consumption of the module circuits.

As described above, the drivers in the liquid crystal display apparatus are basically classified into the signal line driver, the buffer circuit, the control signal generator, the common driver, and the scanning line driver. The power consumption of each circuit will be described below in detail.

(I) Signal Line Driver

Signal line drivers are classified into digital drivers and analog drivers depending on the types of driving ICs for driving the signal lines. Since an OA image is generally based on a digital signal, the power consumption of a digital driver which is consistent with the OA image will be examined.

A digital driving IC is basically constituted by a shift register for determining the signal sampling time, a latch circuit for latching the digital signal, a D/A converter for converting the digital signal latched by the latch circuit into an analog signal, and an output buffer for driving the signal line.

In this case, main factors determining the power consumption are the latch circuit and the output buffer. Just these components will be examined. A maximum power consumption $P_1$ of the latch circuit is given by equation (1) below:

$$P_1=(C_1+2Cck)\times fs/2\times V_1^2 \quad (1)$$

where $C_1$ is the input equivalent capacitance associated with an image signal, Cck is the input equivalent capacitance associated with a sampling clock, fs is the sampling frequency of an image, and $V_1$ is the power supply voltage of the latch circuit.

A maximum power consumption Pob of the output buffer is given by equation (2) below:

$$Pob=Nh\times Css\times fh\times Vs^2/2 \quad (2)$$

where Css is the signal line capacitance, fh is the horizontal driving frequency, Nh is the number of pixels in the horizontal direction, and Vs is the signal line voltage.

(II) Buffer Circuit

The buffer circuit receives a digital signal, performs noise removal or waveform shaping, and supplies a stable signal to the signal line driver. The buffer circuit is sometimes omitted, but it is basically necessary and will be examined below. A maximum power consumption Pb of the buffer circuit is given by equation (3) below:

$$Pb=(2Cbc+Cbp)\times fs/2\times Vb \quad (3)$$

where Cbc of the input equivalent capacitance associated with the clock fs, Cbp is the input equivalent capacitance associated with the image signal, and Vb is the power supply voltage of the buffer circuit.

(III) Control Signal Generator

The control signal generator is generally constituted by a gate array. The internal frequency changes depending on the signal, although the power consumption associated with the sampling clock fs of the image is mainly considered as an Important factor. A maximum power consumption Pga of the entire gate array is given by equation (4):

$$Pga=(2Cgac+Cgap)\times fs/2\times Vga^2 \quad (4)$$

where Cgac is the equivalent internal capacitance associated with the clock fs, Cgap is the input equivalent capacitance associated with the image signal, and Vga is the power supply voltage of the gate array.

(IV) Common Driver

The common driver drives a common capacitor Cc. A maximum power consumption Pc of the common driver is given by equation (5):

$$Pc=Cc\times fc\times Vc^2 \quad (5)$$

where fc is the common driving frequency, and Vc is the power supply voltage of the common driver. In common inversion driving, the common driving frequency fc is ½ the horizontal driving frequency fh.

(V) Scanning Line Driver

The scanning line driver drives a gate line capacitor Cg. A maximum power consumption Pg of the scanning line driver is given by equation (6):

$$Pg=Cg\times fh\times Vg \quad (6)$$

where fg is the scanning line driving frequency, and Vg is the power supply voltage of the scanning line driver. The scanning line driving frequency fg normally equals the horizontal driving frequency fh.

(VI) A Power Consumption Pall of Entire Circuit

The power consumption Pall of the entire circuit is calculated as follows:

$$Pall=P_1+Pob+Pb+Pga+Pc+Pg=(C_1+2Cck)\times fs/2\times V_1^2-Nh\times Cs\times fh\times Vs^2/2+(2Cbc+Cbp)\times fs/2\times Vb^2+(2Cgac+Cgap)\times fs/2\times Vga^2+Cc\times fc\times Vc^2+Cg\times fh\times Vg$$

(When the common power supply voltage is constant, and Nh×Css>>Cg, the power consumption Pall is given by equation (7) below)

$$Pall=(C_1+2Cck+2Cbc+Cbp+2Cgac+Cgap)\times(fs/2)\times V^2+Nh\times Css(fh/2)\times V^2=Pall(C,f,V) \quad (7)$$

The power consumption Pall is represented by the function of a capacitance C, a driving frequency f (the horizontal driving frequency and the clock frequency of the image), and a power supply voltage V of the digital system. The capacitance C is determined by the device structure, and the voltage V is determined by the liquid crystal manufacturing process factors and the V-T characteristics of the liquid crystal, i.e., the capacitance C and the voltage V are determined by the IC and the liquid crystal display panel. However, the frequency f is determined by the system and the image quality such as the horizontal scanning frequency of the image or flicker characteristics, and therefore, can be lowered according to the driving method.

Factors which determine the power consumption of the liquid crystal display panel will be examined next. In the liquid crystal display panel, basically, pixel signals and scanning signals are transmitted through the signal lines and the row scanning lines (gate lines) to display an image, as shown in FIG. 1B. At this time, powers $CsigfV^2$ and $CgfV^2$ are consumed to drive a capacitor Csig of the signal line and the capacitor Cg of the row scanning line, respectively. These power consumption components are regarded as losses because they do not directly contribute to display of the liquid crystal cells CEL.

To reduce the power consumption, the capacitance C, the frequency f, and the voltage V must be lowered. For a still image, the frequency f can be "0". For a moving image, normally, the frequency f cannot be "0". If the complex image is displayed, the pixel voltage of the respective liquid crystal cells CEL frequently change, resulting in an increase in driving power.

In the conventionally proposed LCD with image memories, display signals obtained via the switches SW are held in the pixel memories, and the contents held in the memories are used to display the pixels. In case of still image, this technique allows to lower the driving frequency f or static power consumption. For moving image, however, the driving frequency f must be raised, as a matter of course, so the overall power consumption increases.

The present invention is to provide a liquid crystal display apparatus capable of reducing the power consumption even in moving image display.

The embodiments of the present invention will be described below with reference to the accompanying drawings.

[Technique of Reducing Power Consumption of Liquid Crystal Display Apparatus with Image Memories (I)]

In the first and second embodiments (to be described below) of the present invention, the driver output signal (pixel signal of the signal line driver) for driving the liquid crystal display panel is supplied not as a voltage signal but as a current signal, unlike the prior art. With this arrangement, charge of the signal line capacitor of the liquid crystal display panel upon a change in signal, which cannot be avoided in the conventional voltage driving, is prevented to solve the problem of power consumption posed by the charge of the signal line capacitor.

Figure 2:
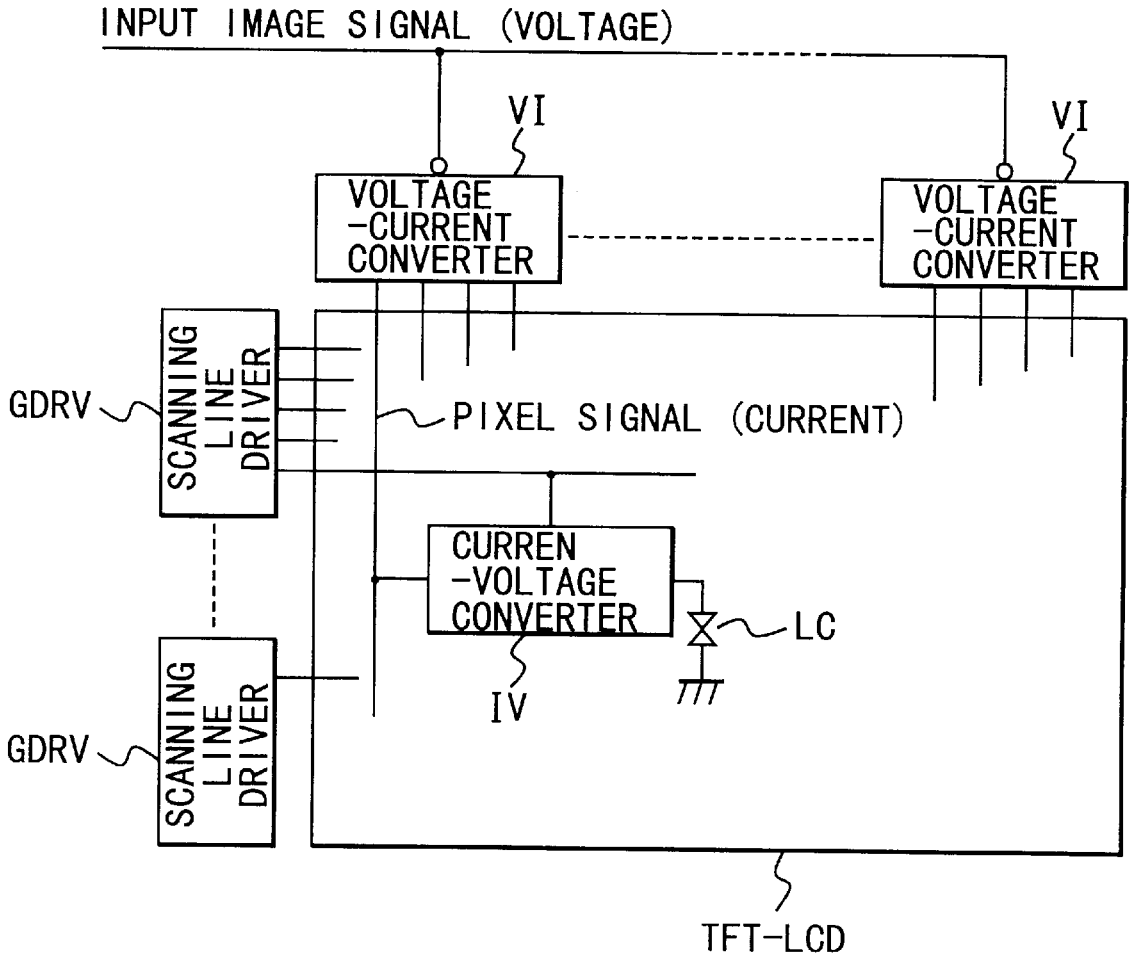
FIG. 2 is a block diagram for explaining the basic concept of the first aspect of the present invention.

FIG. 2 shows the basic concept of the present invention. Referring to FIG. 2, a liquid crystal display panel TFT-LCD is constituted by a plurality of pixels arrayed in a matrix. The plurality of pixels are driven by signal lines corresponding to columns in the column direction, and by row scanning lines corresponding to the rows in the row direction to display an image.

A voltage-current converter VI converts an input image signal supplied as a voltage signal into a current and supplies the current to the signal lines. A scanning (gate) line driver GDRV drives the row scanning lines. A current-voltage converter IV converts the current signal supplied via the signal line into a voltage signal. A liquid crystal LC is a display portion driven by the voltage signal converted by the current-voltage converter IV.

More specifically, an image signal, i.e., a voltage signal is converted into a current signal by the current-voltage converter IV and output to a corresponding one of the plurality of signal lines. The image signal is further converted into a voltage signal by the voltage-current converter VI at a pixel position corresponding to the row driven by the scanning line driver GDRV and is supplied to the liquid crystal LC to display-drive the liquid crystal LC.

As described above, the driver output signal (pixel signal of the signal line driver) for driving the liquid crystal display panel is supplied not as a voltage signal but as a current signal, unlike the prior art. With this arrangement, charge of the signal line capacitor of the liquid crystal display panel upon a change in signal, which cannot be avoided in the conventional voltage driving, is prevented to solve the problem of power consumption generated by the charge of the signal line capacitor.

Embodiments based on this concept will be described below.

(First Embodiment)

Figure 3:
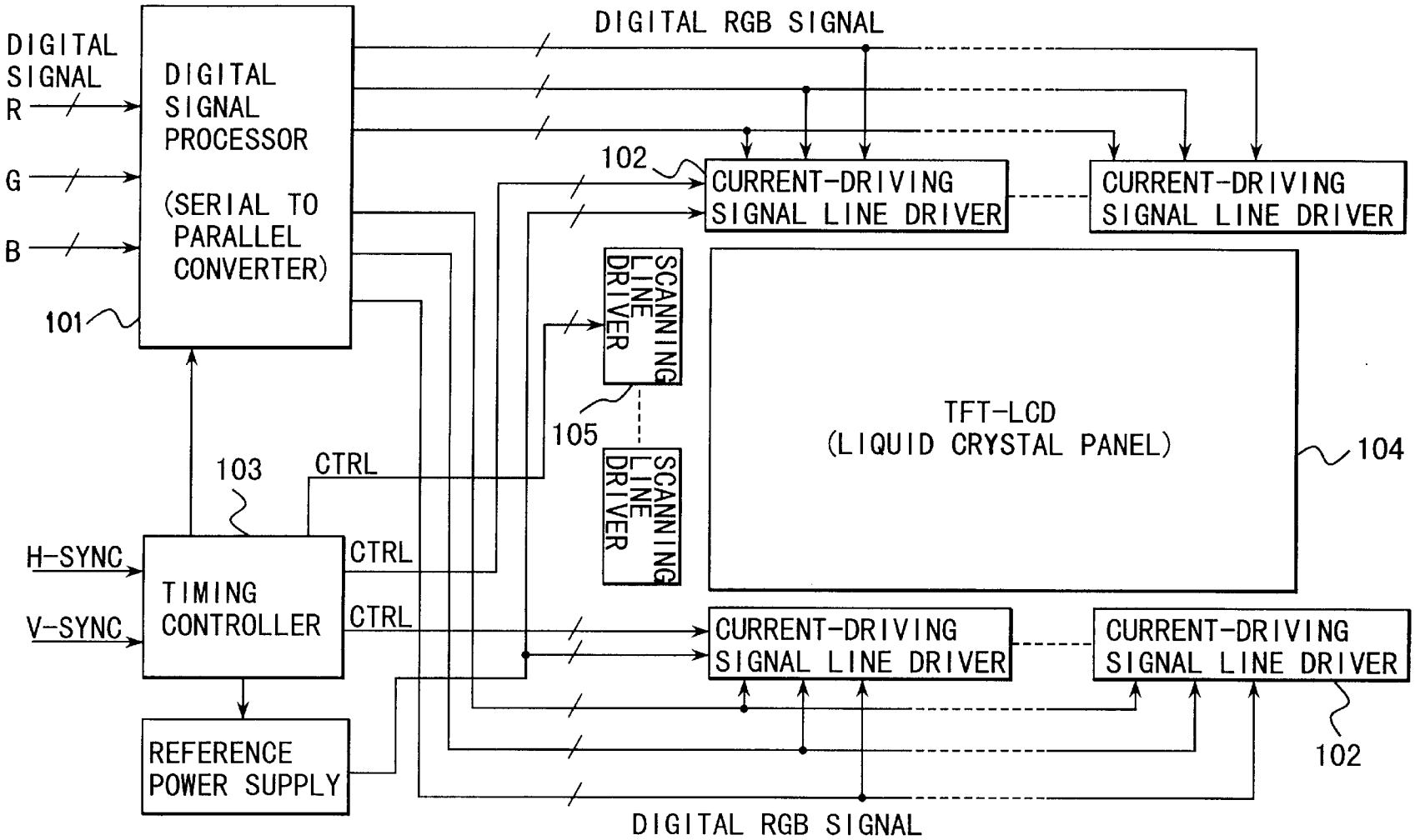
FIG. 3 is a block diagram showing the overall arrangement of a liquid crystal display apparatus according to the first embodiment of the present invention.
Figure 4:
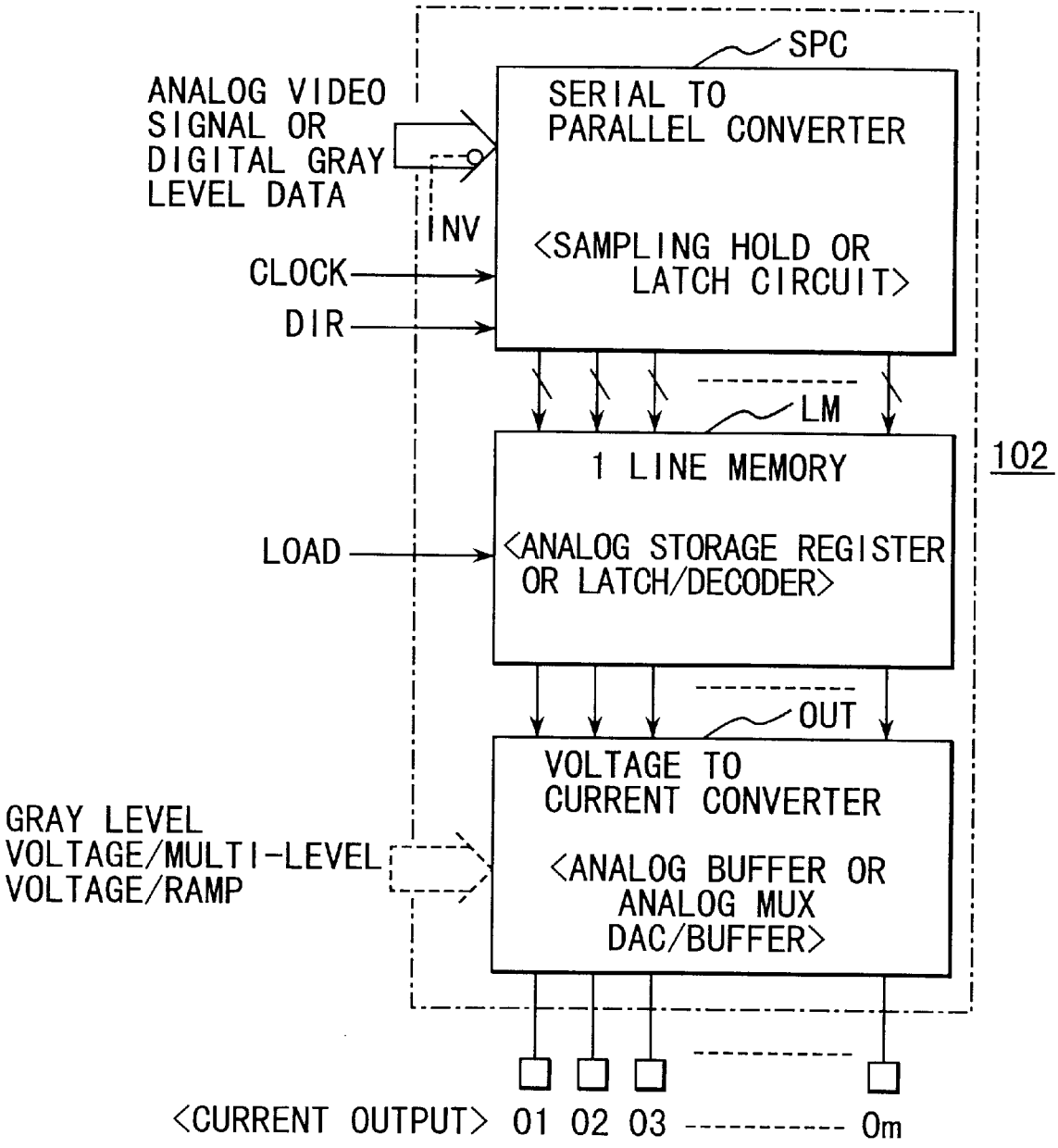
FIG. 4 is a block diagram showing the arrangement of a signal line driver in the first embodiment of the present invention.
Figure 5:
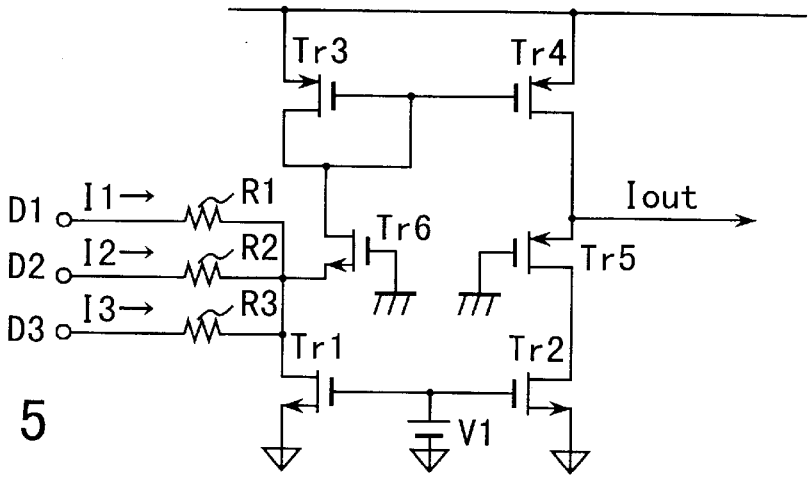
FIG. 5 is a circuit diagram showing the arrangement of the output circuit of the signal line driver in the first embodiment of the present invention.

The first embodiment will be described with reference to FIGS. 3 to 5. FIG. 3 is a circuit diagram of an entire LCD module. FIG. 4 is a circuit diagram of a current-driving signal line driver, i.e., a driver LSI. FIG. 5 is a circuit diagram showing the arrangement of the output circuit of the driver of the present invention.

Referring to FIG. 3, reference numeral 101 denotes a digital signal processor; 102, a current-driving signal line driver; 103, a timing controller; 104, a liquid crystal display panel (TET-LCD); and 105, a scanning line driver.

The liquid crystal display panel (TFT-LCD) has a pixel arrangement as described in FIG. 1B, in which a plurality of small liquid crystal cells CEL are arrayed in a matrix. Row scanning lines La1 to Lam extend in the row direction, and signal lines Lb1 to Lbn extend in the column direction. Switches SW of the respective liquid crystal cells CEL are driven by the corresponding row scanning lines. Pixel signals from the signal lines are supplied to the corresponding liquid crystal cells CEL to display an image.

The liquid crystal cell CEL is applied with a potential corresponding to the potential difference between the applied potential from the signal line and the potential of a common power supply VCOM, thus changing the transparence of the pixel in correspondence with the potential difference.

The current-driving signal line driver 102 is a signal line driver. The current-driving signal line driver 102 receives an image signal, converts the image signal into an analog signal, and outputs the analog signal to the signal line to drive the liquid crystal cell as the pixel of the liquid crystal display panel 104. A plurality of current-driving signal line drivers 102 are arranged in correspondence with the number of signal lines of the liquid crystal display panel 104. The current-driving signal line driver 102 may have a plurality of output terminals and drive a plurality of signal lines through one output terminal.

The digital signal processor 101 receives pixel signals R, G, and B in units of R, G, and B color components. The digital signal processor 101 performs conversion processing to distribute the pixel signals in accordance with the positions of the corresponding signal lines of the plurality of current-driving signal line drivers 102.

The timing controller 103 receives horizontal and vertical sync signals H-SYNC and V-SYNC of an image signal and outputs a clock signal CLOCK and various control signals CTRL for image display. The digital signal processor 101, the current-driving signal line driver 102, and the scanning line driver 105 perform predetermined driving operations for image display on the basis of these signals.

The scanning line driver 105 sequentially outputs driving signals to the plurality of row scanning lines and supplies the signals to the gates of the TFTs constituting the switches SW of the respective liquid crystal cells in units of rows, thereby driving the TFTs.

As shown in FIG. 4, the current-driving signal line driver 102 comprises a serial to parallel converter SPC for serial/parallel-converting an input image signal, a line memory LM for holding the parallel-converted image signal corresponding to one line of the frame, and a voltage to current converter OUT for outputting the one line image signal held in the line memory LM as an analog signal corresponding to the gray level of each pixel. The current-driving signal line driver 102 has a plurality of output terminals corresponding to the respective pixel positions and outputs analog signals for the pixels from the output terminals.

In the arrangement shown in FIG. 3, when the image signals R, G, and B are input to the digital signal processor 101, the digital signal processor 101 distributes the signals to the current-driving signal line drivers 102 arranged in correspondence with a predetermined pixel region. This timing is controlled by the timing controller 103.

The signal sent to the current-driving signal line drivers 102 is serial/parallel-converted (S/P-converted) in accordance with the clock signal CLOCK from the timing controller 103, and then supplied to the line memory LM having a storage capacity of one line memory and held in the line memory LM.

The line memory LM outputs one held line signal to the converter OUT in accordance with the write timing of a signal LOAD from the timing controller 103. The converter OUT D/A-converts this signal into an analog signal and supplies the analog signal to the corresponding signal lines, thereby driving the liquid crystal display panel 104.

Figure 6:
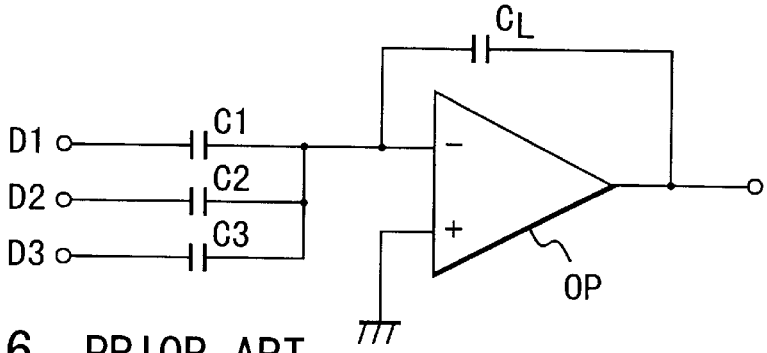
FIG. 6 PRIOR ART
FIG. 6 is a circuit diagram showing a conventional driver arrangement of a perfect D/A conversion scheme.

Various schema can be used for the D/A conversion by the converter OUT. A general arrangement called a perfect D/A conversion scheme in which D/A converters are individually provided on the output sides of the signal lines is shown in FIG. 6.

In the conventional perfect D/A conversion scheme, when 3 bit signals are to be received and converted into analog signals, capacitors C1, C2, and C3 are arranged on the input side such that the received signals are supplied to the inverting input terminal of an operational amplifier OP through the capacitors C1, C2, and C3. The noninverting input terminal of the operational amplifier OP is grounded. The output terminal and the inverting input terminal of the operational amplifier OP are connected through a capacitor CL. The input digital signals (pixel signal data) consisting of a total of three bits, i.e., bit data D1, D2, and D3 are input through the capacitors C1, C2, and C3, respectively. The following relationship holds among the capacitors C1, C2, and C3:

$$C1:C2/2=C3/4$$

The 3 bit input digital signals D1, D2, and D3 are added by an adder constituted by the capacitors C1, C2, and C3 (C1:C2/2=C3/4), the capacitor CL, and the operational amplifier OP. The digital signal is D/A-converted into an analog voltage signal corresponding to the data value and used as a liquid crystal cell driving voltage.

That is, in this arrangement, the digital signal input as a voltage signal is converted into a voltage driving signal. When the signal line capacitor of the liquid crystal display panel 104 to be driven is represented by Cp, a power $P=CpfV^2$ is wasted. When one pixel capacitance of the liquid crystal display panel is represented by CLC, only a power of $CLCfV^2$ (CLC<<Cp) should be consumed, although, in fact, the power of $CpfV^2$ is wasted.

As a specific example of an improvement therefor, FIG. 5 shows the output circuit of the driver of the present invention. The D/A converter of the first embodiment of the present invention converts input digital signal voltages into currents, simply weights and adds the currents, and outputs a current.

In the arrangement shown in FIG. 5, 3 bit signals are received and converted into analog signals. Resistors R1, R2, and R3 are arranged on the input side. The total of 3 bit input digital signals D1, D2, and D3 are input through the resistors R1, R2, and R3, respectively.

Of transistors (FETs) Tr1 to Tr6, the transistors Tr1 and Tr2 constitute a constant power supply (current source), and the transistors Tr3 and Tr4 constitute a current mirror circuit. The transistor Tr5 makes the output voltage constant.

The resistors R1, R2, and R3 are arranged to convert the 3 bit input digital signals D1, D2, and D3 into currents and add the currents. The current signal obtained by converting the input digital signals D1, D2, and D3 into current values and adding the current values is input to the gate and drain of the transistor Tr3 and the gate of the transistor Tr4.

The transistors Tr1 and Tr2 constitute the constant current source, and the transistors Tr3 and Tr4 constitute the current mirror circuit. With this arrangement, when the data values of the bit data D1, D2, and D3 are "0" (logic level "L"), the current values of the resistors R1, R2, and R3 are "0", so currents I1, I2, and I3 from the resistors R1, R2, and R3 do not change. In this case, no current flows from an output terminal Iout (in other words, the same current flows to the transistors Tr1, Tr2, Tr3, and Tr4).

However, when any one of the data values of the bit data D1, D2, and D3 changes to "1" (logic level "H"), and the current I1 (or I2 or I3) is generated from the resistor R1 (or R2 or R3) to which the data of level "1" is input, the current flowing to the transistors Tr3 and Tr4 changes accordingly, and the current output Iout changes. That is, the driving output current can be changed by the digital input voltage.

Figure 7A:
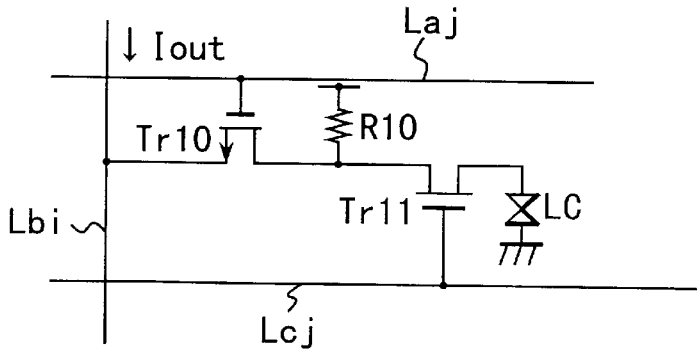
FIGS. 7A and 7B are circuit diagrams respectively showing the arrangement of a pixel using a resistor in a current-voltage converter and the arrangement of a pixel using a capacitor in the current-voltage converter in the first embodiment of the present invention.
Figure 7B:
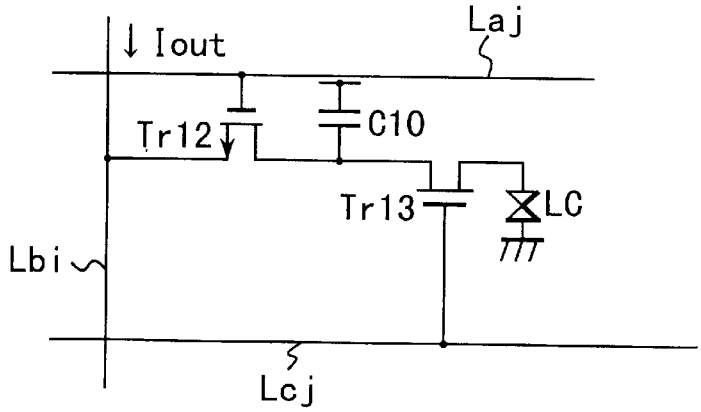

The output driving current is converted, in FIG. 7A, by a current-voltage converter constituted by a transistor Tr10 and a resistor R10, or in FIG. 7B, by a current-voltage converter constituted by a transistor Tr12 and a capacitor C10 into a voltage and applied to the liquid crystal through a switch Tr11 or Tr13.

FIGS. 7A and 7B are circuit diagrams showing the arrangements of the liquid crystal cell of one pixel in the liquid crystal display panel 104. In FIG. 7A, the signal of the gate driving line is supplied to the gate of the transistor Tr10 constituting the switch, and the current output Iout is input to the drain side of the transistfor TR10 through the signal line. The voltage on the source side of the transistor TR10 is applied to the driving electrode of the liquid crystal cell LC via the drain-source path of the transistor Tr11.

The resistor R10 is a resistor for converting the current into a voltage. The current output Iout received through the transistor TR10 is flows to the resistor R10 and is converted into a voltage. This voltage is used as a driving voltage for the liquid crystal cell LC through the transistor Tr11.

The transistor Tr11 is a switch for determining the driving period of the liquid crystal cell LC and is controlled by a control line Lcj. While the transistor Tr11 is ON, the liquid crystal cell LC displays the pixel at a gray level corresponding to the current output Iout.

In FIG. 7B, the signal of the scanning line (gate line) is supplied to the gate of the transistor Tr12 constituting the switch, and the current output Iout is input to the drain side of the transistor Tr12 via the signal line. The current output Iout from the source side of the transistor Tr12 is supplied to the driving electrode of the liquid crystal cell LC via the drain-source path of the transistor Tr13. The capacitor C10 is a capacitor for storing pixel data. The capacitor C10 accumulates the current output Iout received in the ON state of the transistor Tr12 and holds the current output Iout. The transistor Tr13 is a switch for determining the driving period of the liquid crystal cell LC and is controlled by the control line Lcj. While the transistor Tr13 is ON, the liquid crystal cell LC displays the pixel at a gray level corresponding to the voltage held in the capacitor C10.

In FIG. 7A, the current is flows to the resistor and is converted into a voltage while, in FIG. 7B, charges are accumulated in the capacitor and converted into a voltage. When the switch resistance is high, a voltage is generated in the signal line upon flowing the current to the resistor. For this reason, as the transistors Tr10, Tr11, Tr12, and Tr13, single-crystal silicon or polysilicon devices having a low ON resistance are preferably used.

When the liquid crystal cell is driven at a low speed, the current flowed per unit time decreases, and a lower voltage is generated. Thus, a low-speed driving method proposed in Jpn. Pat. Appln. KOKAI Publication No. 3-271795 may be used to ensure a sufficient driving time.

As described above, the D/A converter of the first embodiment converts input digital signal voltages as pixel signals into currents, simply weights and adds the currents, and outputs the current. With this scheme of converting a voltage into a current, even when the information contents of the pixel signal change, the voltage does not change. Therefore, the power is prevented from being wastefully consumed even when charges are stored/removed in/from the signal line capacitor Cp of the liquid crystal display panel 104, unlike the prior art in which the power is inevitably wasted in a change in voltage.

Another example of the D/A converter which allows to generate and transmit the current output Iout to drive the liquid crystal cell with a low power consumption will be described next as the second embodiment.

(Second Embodiment)

Figure 8:
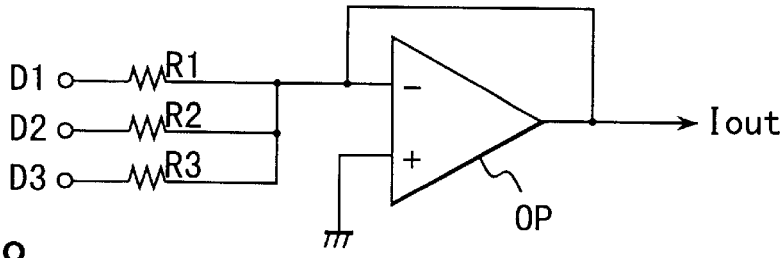
FIG. 8 is a circuit diagram showing the arrangement of the output circuit of a signal line driver in the second embodiment of the present invention.

FIG. 8 is a circuit diagram of the output circuit of a signal line driver in a liquid crystal display apparatus according to the second embodiment of the present invention. A 3 bit input arrangement will be described below. Resistors R1, R2, and R3 are arranged on the input side, and input signals are supplied to the inverting input terminal of an operational amplifier OP through the resistors R1, R2, and R3. The noninverting input terminal of the operational amplifier OP is grounded. The output terminal and the inverting input terminal of the operational amplifier are connected.

Three input bit signals (pixel signal data) D1, D2, and D3 are input through the resistors R1, R2, and R3, respectively.

In the arrangement shown in FIG. 8, a constant voltage is output to equalize the voltage on the signal line as an output target, and the operational amplifier is used to allow to transmit the pixel information as a current signal. That is, since the output from the operational amplifier is a current signal, the display signals (pixel signals) converted into currents by the resistors R1, R2, and R3 are output from the operational amplifier OP to the signal line as a current output Iout.

To prevent variations in potential of the signal line upon flowing the output current to the TFT switch with an ON resistance in the liquid crystal cell or a resistor for converting the current into a voltage, a constant voltage is applied by the operational amplifier buffer (operational amplifier OP), so that the signal is transmitted as a current under this constant voltage.

As a result, the potential of the signal line does not vary. A signal line capacitor Cp of a liquid crystal display panel 104 to be driven need not be charged/discharged, so a power P is prevented from being wastefully consumed by the signal line capacitor Cp.

In the first and second embodiments described above, when image signals are to be converted into pixel signals for driving the individual pixels, the voltage signal is converted into a current signal by the current-driving signal line driver 102 serving as a pixel signal driver. The present invention can also be applied to the stage previous to this processing, e.g., a case wherein the RGB signal input section itself of the liquid crystal module (general term for the liquid crystal display panel and its peripheral controllers) processes the current signal, or a case wherein a digital signal processing section converts the voltage signal into a current signal upon receiving the voltage signal.

By supplying the pixel signal as a current signal, the output period of the current as the pixel signal can be made shorter than that for driving one line of the liquid crystal display panel without any problem. When the current has an almost constant value, the output period of the current as the pixel signal can be changed depending on the gray level of the display image.

As described above in detail, in the first and second embodiments, the signal for pixel display is transmitted as a current signal and used to drive the liquid crystal cell. With this arrangement, the voltage for driving the signal line capacitor can be made to almost zero, so that the power consumption for driving the signal line capacitor can be made to almost zero. Consequently, the power consumption can be largely reduced. When the driving time is shortened, and high-speed driving is required, the driving signal can be transmitted at a high speed without being limited by the signal line capacitor and the time constant of the resistor. In addition, by applying current driving not only to the signal lines but also to the entire liquid crystal module (e.g., the liquid crystal module itself receives a current), driving at a higher speed and a further reduction in power consumption are enabled.

[Technique of Reducing Power Consumption of Liquid Crystal Display Apparatus with Image Memories (II)]

Figure 9:
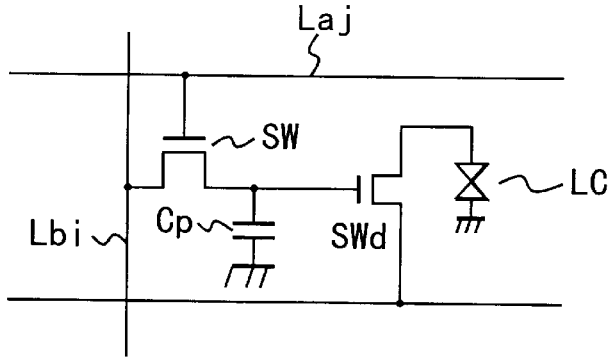
FIG. 9 PRIOR ART
FIG. 9 is a circuit diagram showing the pixel arrangement of a general liquid crystal display apparatus with pixel memories.

To further reduce the power consumption, the liquid crystal display apparatus has a memory (pixel memory capacitor Cp) for every pixel, as shown in FIG. 9, to store the pixel display signal. To display an image, the signals stored and held in the memories are used. As has already been described, for a still image, once display signals are transmitted to the respective pixels, the held signals may always be displayed. Theoretically, only the power for polarity inversion is consumed, so that the power consumption can be made to almost zero.

However, an increase in requirements for displaying moving images degrades the power consumption reduction effect. The power consumption of the liquid crystal display panel depends on the basic arrangement of the liquid crystal display panel in which the pixel signals and scanning signals are transmitted through the signal lines and the scanning lines (gate lines) and displayed. In this case, to drive the signal line capacitor Csig and the scanning line capacitor Cg, powers of $Csig \times fV^2$ and $Cg \times fV^2$ are consumed, respectively.

To reduce such power consumption, the capacitance C, the frequency f, and the voltage V must be lowered. However, for a moving image, the frequency f cannot be zero. If the image is complex, the driving power increases. That is, the liquid crystal display apparatus with pixel memories lowers the driving frequency f or static power consumption in still image display. However, in moving image display, the frequency f increases, as a matter of course, so the overall power consumption increases upon driving the capacitor C.

In the first and second embodiments, the pixel signal is supplied as a current signal to prevent the signal line capacitor from being driven, thereby reducing the power consumption. In the third to ninth embodiments to be described below, by decreasing the amplitude of the pixel signal, the power consumption of the signal line driver for outputting the pixel signal is reduced, and the power consumed by the capacitor of the signal line for transmitting the pixel signal is reduced, thereby reducing the power consumption.

(Third Embodiment)

Figure 10:
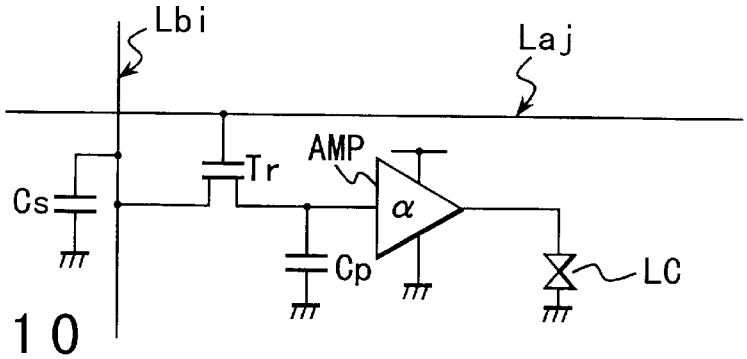
FIG. 10 is a circuit diagram showing the pixel arrangement of the third embodiment of the present invention.

FIG. 10 is an equivalent circuit diagram of one pixel in a liquid crystal display apparatus according to the third embodiment of the present invention. Referring to FIG. 10, reference symbol Laj denotes a row scanning line (gate driving line); Lbi, a signal line; Tr, a TFT switch; AMP, an amplifier with an amplification factor α; LC, a liquid crystal cell; Cp, a pixel memory capacitor; and Cs, a signal line capacitor.

An image signal sent via the signal line Lbi is supplied to the pixel memory capacitor Cp through the TFT switch Tr and held in the pixel memory capacitor Cp. The pixel signal held in the pixel memory capacitor Cp is amplified by the amplifier AMP and supplied to the liquid crystal cell LC to drive the liquid crystal cell LC.

In this arrangement, while the gate driving signal is supplied to the row scanning line (gate driving line) Laj, the TFT switch Tr receives the gate signal and is turned on. The image signal sent via the signal line Lbi is sampled and held by the TFT switch Tr in the ON state, supplied to the pixel memory capacitor Cp, and held in the pixel memory capacitor Cp. The held image signal is amplified by the amplifier AMP by α and supplied to the liquid crystal cell LC to drive the liquid crystal cell LC.

In the third embodiment, the amplifier for amplifying the signal held in the memory (pixel memory capacitor Cp) for storing the pixel signal in units of pixels is arranged. With this arrangement, the pixel signal is amplified by the amplifier by α and used to drive the liquid crystal cell LC. When this arrangement is employed, the pixel signal transmitted to the signal line requires a level corresponding to just 1/α a the signal level necessary for driving the liquid crystal cell. For this reason, even when the pixel signal is supplied as a voltage signal, the amplitude level can be reduced to 1/α that of the liquid crystal driving voltage. Accordingly, the power consumed by the signal line capacitor and the power consumed by the signal line driver are decreased. Therefore, the power consumption can be reduced.

Normally, the signal line capacitance is larger than the pixel capacitance by about two orders of magnitudes. Lowering the level of the pixel signal for driving the signal line capacitor to 1/α the signal level necessary for driving the liquid crystal cell contributes to largely reduce the power consumption in moving image display on the liquid crystal display panel having the enormous number of pixels. Impedance conversion conducted by the above construction enables a constant low impedance driving with the result that one line driving of any liquid crystal display panel can be performed if a sufficiently long time driving is allowed.

(Fourth Embodiment)

Figure 11:
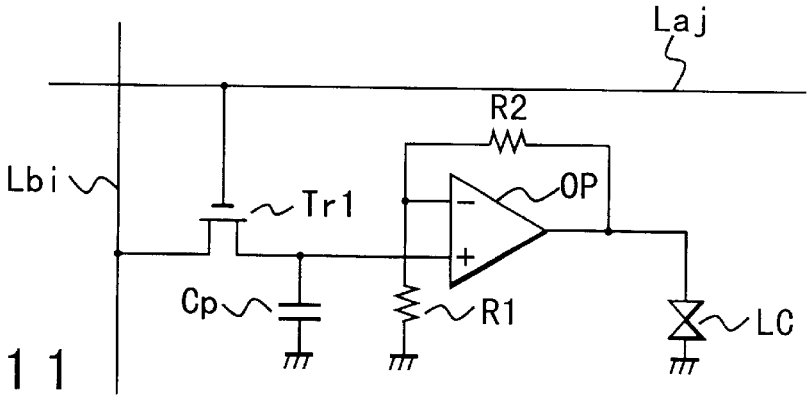
FIG. 11 is a circuit diagram showing the pixel arrangement of the fourth embodiment of the present invention.

FIG. 11 is an equivalent circuit diagram of one pixel in a liquid crystal display apparatus according to the fourth embodiment of the present invention. In this embodiment, the amplifier AMP in the third embodiment is constituted by an operational amplifier. In this embodiment, to constitute the amplifier AMP by an operational amplifier OP, the inverting input terminal of the operational amplifier OP is grounded through a resistor R1 and also connected to the output terminal of the operational amplifier OP through a resistor R2.

The noninverting input terminal of the operational amplifier OP is connected to a signal line Lbi through the source-drain path of a TFT switch Tr1 to receive a pixel signal from the signal line Lbi while the transistor Tr1 is kept on. The noninverting input terminal of the operational amplifier OP is grounded through a memory capacitor Cp. The gate of the TFT transistor Tr1 is connected to a row scanning line (gate driving line) Laj. The output side of the operational amplifier OP is connected to a liquid crystal cell LC so that the liquid crystal cell LC is driven in accordance with an output from the operational amplifier OP. Note that the TFT transistor Tr1 serves as a sampling switch which is turned on upon receiving a gate signal while the gate driving signal is supplied to the row scanning line (gate driving line) Laj.

The pixel signal sent via the signal line Lbi is supplied to the pixel memory capacitor Cp through the TFT transistor Tr1 and held in the pixel memory capacitor Cp. The pixel signal held in the pixel memory capacitor Cp is amplified by the operational amplifier OP by α and supplied to the liquid crystal cell LC to drive the liquid crystal cell LC.

In this arrangement, the amplification factor α of the operational amplifier OP can be represented by the following equation:

$$\alpha=1+R2/R1$$

More specifically, the amplifier for amplifying the level of the pixel signal by α can be realized by setting the resistors R1 and R2 such that 1+R2/R1=α holds. With this arrangement, the level of the pixel signal to be supplied to the signal line can be lowered to 1/α a that in an arrangement without any amplifier.

(Fifth Embodiment)

Figure 12:
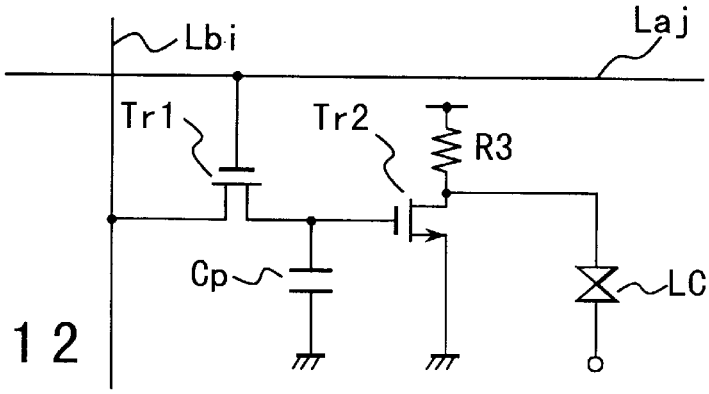
FIG. 12 is a circuit diagram showing the pixel arrangement of the fifth embodiment of the present invention.

FIG. 12 is an equivalent circuit diagram of one pixel in a liquid crystal display apparatus according to the fifth embodiment of the present invention. In the fifth embodiment, the amplifier AMP shown in FIG. 10 is constituted by a TFT transistor Tr2 and a resistor R3. A signal held in a pixel memory capacitor Cp is input to the gate of the TFT transistor Tr2, and the source electrode of the TFT transistor Tr2 is connected to the DC power supply line having a positive polarity through the resistor R3. The drain electrode of the TFT transistor Tr2 is grounded.

The signal component held in the pixel memory capacitor Cp is amplified by the TFT transistor Tr2 serving as an amplifier by an amplification factor α and output to drive a liquid crystal cell LC. When the transconductance of the TFT transistor Tr2 is represented by gm, the amplification factor of the TFT transistor Tr2 is represented by gm×R3.

More specifically, when the amplifier for amplifying the level of the pixel signal by α is to be constituted by the resistor R3 and the TFT transistor Tr2, the resistor R3 is set in correspondence with α/gm.

In the third to fifth embodiments, the pixel memory capacitor Cp for holding the pixel signal in units of pixels and the amplifier for amplifying the signal held in the pixel memory capacitor Cp and supplying the signal to the liquid crystal cell are arranged. With this arrangement, the level of the pixel signal to be supplied to the signal line can be lowered by the amplification factor of the amplifier.

In this arrangement, the amplifier is arranged for every pixel. In a liquid crystal display panel having an enormous number of pixels, the amplifiers of the respective pixels are always wastefully operated. The sixth embodiment will be described next in which the amplifier is operated only when the liquid crystal cell must be driven, thereby further reducing the power consumption.

(Sixth Embodiment)

Figure 13:
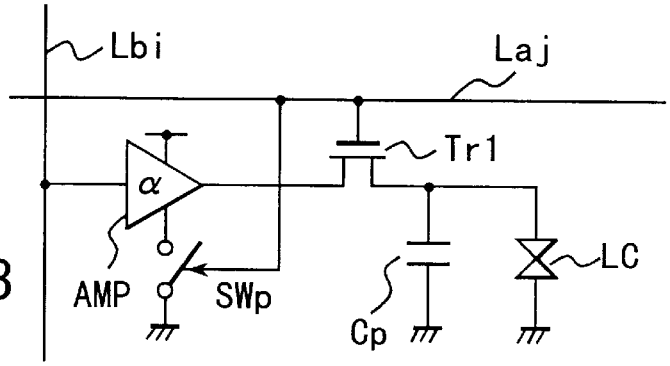
FIG. 13 is a circuit diagram showing the pixel arrangement of the sixth embodiment of the present invention.

FIG. 13 is an equivalent circuit diagram of one pixel in a liquid crystal display apparatus according to the sixth embodiment of the present invention. In this embodiment, a pixel signal in a signal line Lbi is amplified by an amplifier AMP, supplied to a pixel memory capacitor Cp through a TFT transistor Tr1 serving as a sampling switch, and held in the pixel memory capacitor Cp.

While a gate driving signal is supplied from a row scanning line (gate driving line, gate line) Laj, the TFT transistor Tr1 is kept on so that an output from the amplifier AMP is stored in the pixel memory capacitor Cp. In this embodiment, a switch SWp which is turned on/off in accordance with the gate driving signal from the row scanning line Laj is arranged such that the amplifier AMP is turned on/off in synchronism with the gate driving signal, and the power supply for the amplifier AMP is ON/OFF-controlled by the switch SWp.

When the amplifier is arranged for every pixel, the static power is consumed by the amplifiers of all pixels. As in the third to fifth embodiments, when the amplifiers of all the pixels are always operated, the liquid crystal display panel having the enormous number of pixels consumes a very large static power.

In the arrangement shown in FIG. 13, the amplifier AMP is connected to the input of the sampling switch Tr1. An image signal sent via the signal line Lbi is amplified by the amplifier AMP and then supplied to the pixel memory capacitor Cp through the sampling switch Tr1. The amplifier AMP has the power-ON/OFF switch SWp for ON/OFF-controlling the power supply for the amplifier AMP. The power-ON/OFF switch SWp is turned on while the gate driving signal is received from the row scanning line Laj.

With this arrangement, the amplifier AMP is operated only while the gate driving signal is received, so the amplifier AMP consumes no static power in an OFF state. In this embodiment, the power-ON/OFF switch SWp is ON/OFF-controlled in accordance with the gate driving signal from the row scanning line Laj. The reason for this will be described below.

If, in the OFF state of the amplifier AMP, the TFT transistor Tr1 serving as a sampling switch is ON, a signal "0" from the amplifier AMP is stored in the pixel memory capacitor Cp. To prevent this, the power-ON/OFF switch SWp is switched in accordance with the gate driving signal from the row scanning line Laj such that the power-ON/OFF switch SWp operates in synchronism with the TFT transistor Tr1.

In this embodiment, since both the power-ON/OFF switch SWp and the TFT transistor Tr1 use the gate driving signal, these two components are turned on/off in synchronism with each other. While the power-ON/OFF switch SWp is OFF, the pixel memory capacitor Cp is completely disconnected from the output side of the amplifier AMP by the TFT transistor Tr1. For this reason, no erroneous signal is held in the pixel memory capacitor Cp. In addition, the amplifier AMP may be turned on only when the pixel signal is to be sampled and held.

When the power-ON/OFF switch SWp which is turned on only during the write period of the pixel signal in a corresponding pixel, i.e., only while the corresponding pixel is selected, is arranged, the amplifier AMP operates only while the pixel is selected and consumes the power. However, the amplifier AMP does not operate for the remaining period, so no power is consumed.

With this arrangement, even when the amplifier AMP is arranged for every pixel, almost no power is always consumed by the amplifier AMP. Therefore, when the display image contents need not be rewritten, almost no power is consumed.

In the third to sixth embodiments, the amplifier is arranged to amplify the pixel signal and supply the amplified signal to the liquid crystal cell. With this arrangement, the level of the pixel signal to be transmitted from the signal Line driver to each pixel is lowered to reduce the power consumption. For a moving image, the image can be reconstructed and displayed by supplying the difference signal between two frames. In this case as well, charge/discharge of the signal line capacitor can be suppressed to reduce the power consumption. An example will be described next.

(Seventh Embodiment)

Figure 14:
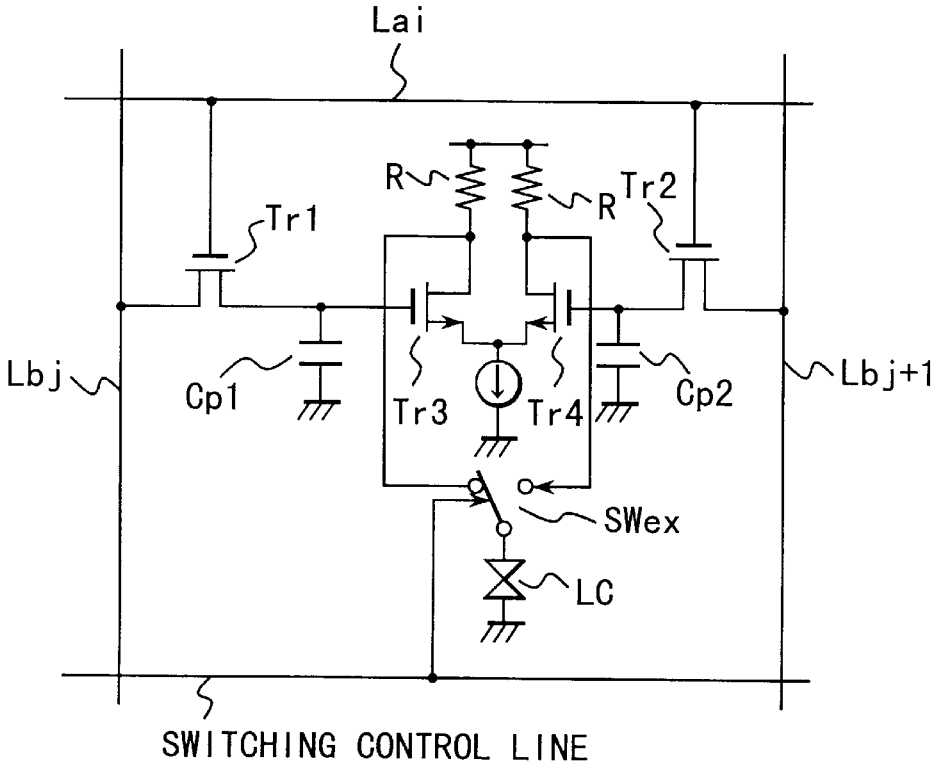
FIG. 14 is a circuit diagram showing the pixel arrangement of the seventh embodiment of the present invention.

FIG. 14 is an equivalent circuit diagram of one pixel in a liquid crystal display apparatus according to the seventh embodiment of the present invention. In FIG. 14, a differential amplifier is constituted by transistors Tr3 and Tr4. A pixel signal is sent to the gate of one transistor Tr3 of the differential amplifier through a sampling switch (TFT transistor Tr1), and a pixel signal is sent to the gate of the other transistor Tr4 of the differential amplifier through a sampling switch (TFT transistor Tr2).

The sent pixel signals are held in a pixel memory capacitor Cp1 arranged on the gate side of one transistor Tr3 and a pixel memory capacitor Cp2 arranged on the gate side of the other transistor Tr4, respectively. An output from one transistor Tr3 of the differential amplifier and an output from the other transistor Tr4 are selectively supplied to a liquid crystal cell LC by a selection switch SWex.

In the arrangement shown in FIG. 14, an image signal is sent as signals for differential amplification. For this purpose, two signal lines are required for one pixel. The number of signal lines becomes twice that of the normal arrangement. However, since the difference between the two signals is used, the signal voltage itself can be lowered (½ or less). Therefore, the power consumption can be further reduced.

With the above arrangement, signals having opposite polarities can be simultaneously generated. Only by arranging the selection switch SWex, polarity inversion can be performed in the Dixel. More specifically, a normal pixel memory can hold only one DC voltage signal as the pixel signal. The liquid crystal cell must perform DC driving because it uses the DC voltage signal. In this embodiment, however, signals having positive and negative polarities, i.e., signals which allow AC driving can be simultaneously supplied in units of pixels. Therefore, even if polarity inversion is necessary, the contents in the pixel memory capacitor need not be rewritten.

(Eighth Embodiment)

Figure 15:
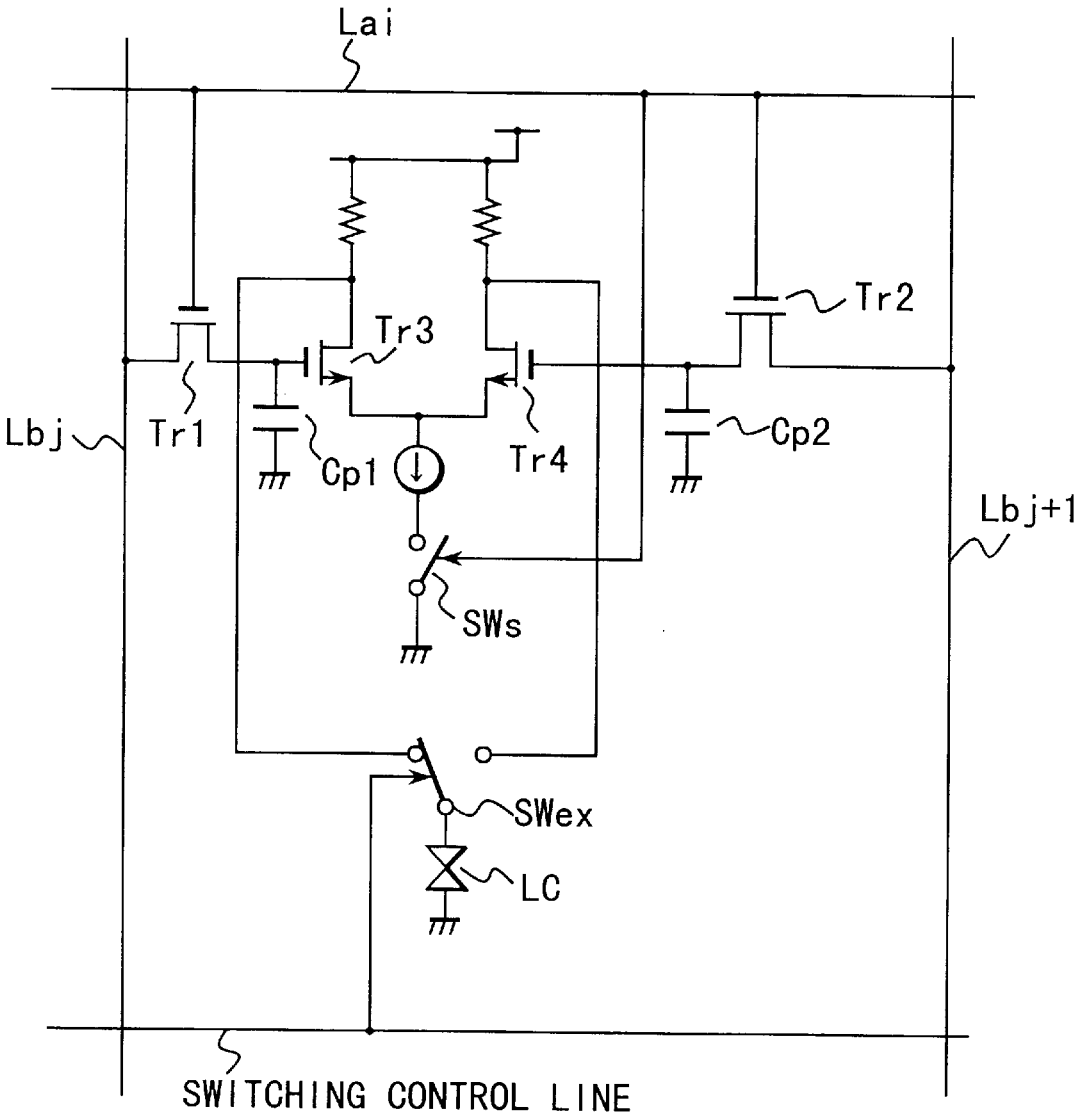
FIG. 15 is a circuit diagram showing the pixel arrangement of the eighth embodiment of the present invention.

FIG. 15 is an equivalent circuit diagram of one pixel in a liquid crystal display apparatus according to the eighth embodiment of the present invention. Unlike the seventh embodiment, the arrangement of the eighth embodiment is characterized by further comprising a switch for operating only the differential amplifier of a selected pixel.

A differential amplifier consisting of transistors Tr3 and Tr4 has the same arrangement as that of the seventh embodiment. An output from one transistor Tr3 of the differential amplifier and an output from the other transistor Tr4 are selectively supplied to a liquid crystal cell LC by a selection switch SWex at a predetermined period (e.g., in units of fields). The selection switch SWex is controlled by a signal in a switching control line.

To ON/OFF-control the operation of the differential amplifier, an opening/closing switch SWs is inserted into the constant current source of the differential amplifier. The opening/closing switch SWs is closed only when the corresponding pixel is selected in accordance with the gate driving signal in a row scanning line (gate driving line, gate line) Laj corresponding to the pixel.

With this arrangement, only when a certain pixel is selected, the differential amplifier belonging to the pixel operates. Therefore, the remaining differential amplifiers do not consume the power, thus further reducing the power consumption.

(Ninth Embodiment)

Figure 16:
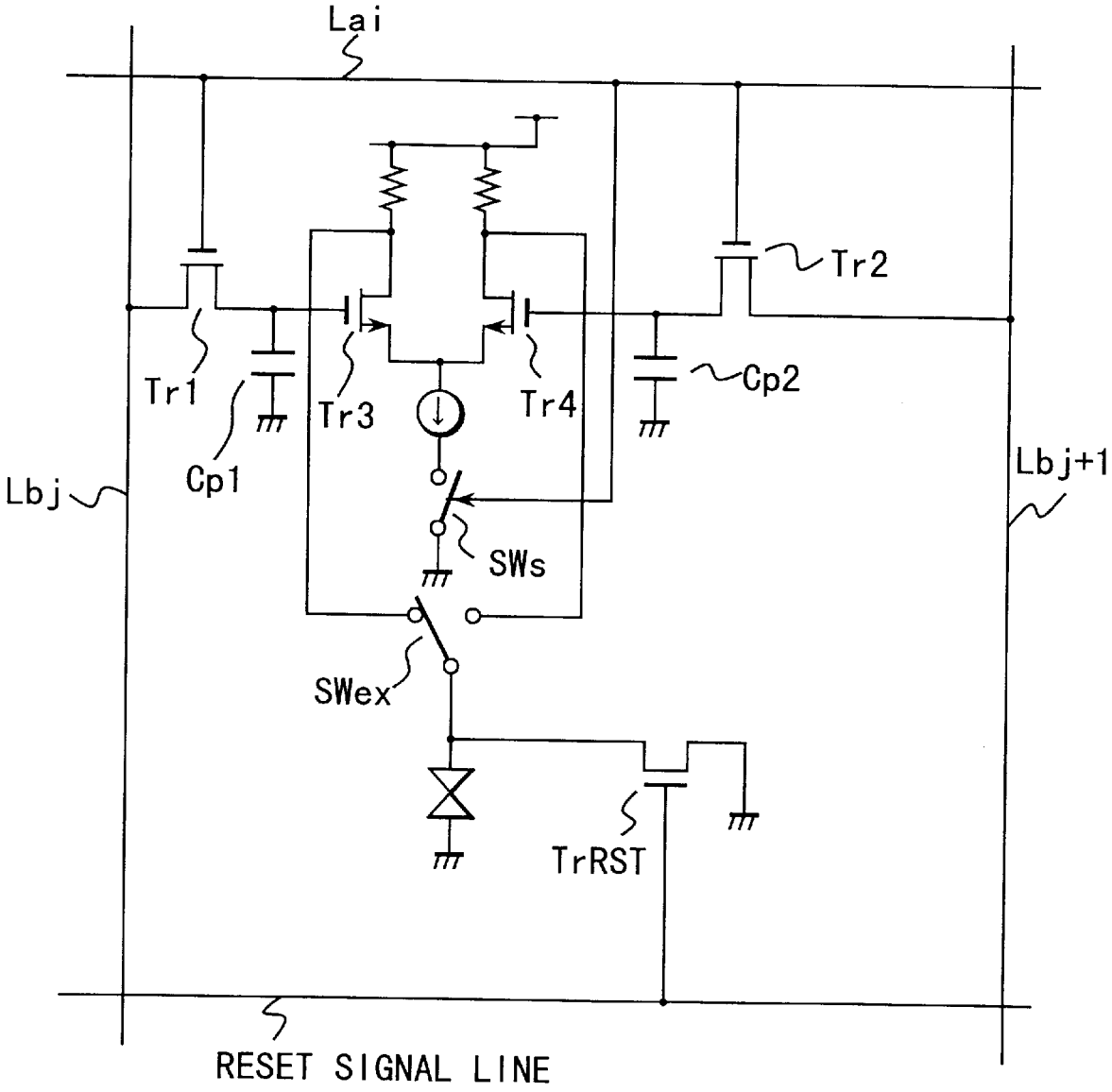
FIG. 16 is a circuit diagram showing the pixel arrangement of the ninth embodiment of the present invention.

FIG. 16 is an equivalent circuit diagram of one pixel in a liquid crystal display apparatus according to the ninth embodiment of the present invention. In the ninth embodiment, a transistor TrRST for supplying a reset signal is arranged on the selection/output side of a selection switch SWex in the eight embodiment.

More specifically, in the eighth embodiment, an output from one transistor Tr3 of the differential amplifier and an output from the other transistor Tr4 are selectively supplied to a liquid crystal cell LC by the selection switch SWex. In addition, the transistor TrRST is arranged to ground the selection/output stage of the selection switch SWex. The transistor TrRST is reset by a reset signal supplied from a reset signal line.

With this arrangement, by changing the current flowing to the differential transistors Tr3 and tr4 by the difference between the pixel signals, charges accumulated in the liquid crystal capacitor, i.e., the voltage can be changed. However, since the current is finally converted into a voltage, charges accumulated in pixel memory capacitors Cp1 and Cp2 must be reset. For this purpose, the transistor TrRST is arranged to ground the selection/output side of the selection switch SWex during reception of the reset signal.

More specifically, when the signal held in the pixel memory is to be rewritten, charges in the pixel memories (capacitors) Cp1 and Cp2 of the rewrite target are nulled (reset). Thereafter, the current flowing to the pixel memories and the current flowing time are controlled to finally obtain a driving voltage corresponding to the signals supplied to the signal lines. Advancing this idea, a technique of inputting a current from the signal line and converting the current into a voltage in the pixel is also available.

According to the third to ninth embodiments, when the pixel signal is supplied as a voltage signal, the pixel signal voltage can be lowered, and the voltage for charging/discharging the signal line capacitor for transmitting the pixel signal can also be lowered. For this reason, the power consumed to charge/discharge the signal line capacitor can be largely reduced. Even when the liquid crystal driving voltage becomes high, the signal line voltage can be lowered. Therefore, when the driver voltage is lowered (e.g., 1 [V]) in the future, the same driver can be continuously used by changing only the circuit arrangement of the pixel portion.

[Technique of Reducing Power Consumption of Liquid Crystal Display Apparatus with Image Memories (III)]

To reduce the dynamic power consumption not only for still image display but also for moving image display in a liquid crystal display apparatus with pixel memories, an example in which difference signal driving and current driving are used together to further reduce the power consumption will be described below. A technique using the difference voltage between two frames will be described.

Figure 17:
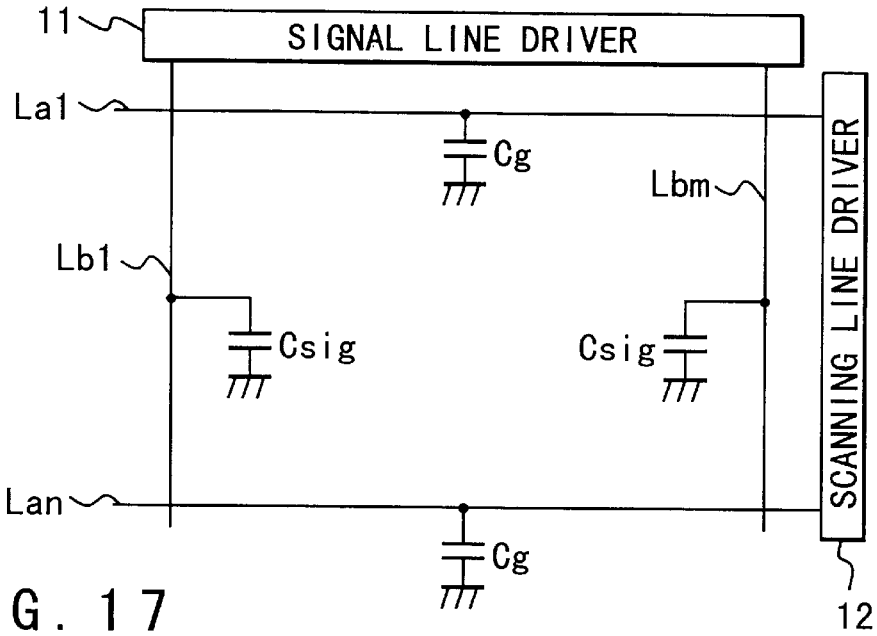
FIG. 17 is a block diagram for defining the type of a parasitic capacitance in a liquid crystal display panel and display on the liquid crystal display panel.

The power consumption of a liquid crystal display panel depends on a signal line capacitor Csig, a rewrite frequency fsig of a pixel signal, and a pixel signal voltage Vsig. In the liquid crystal display panel, basically, image signals (pixel signals) and row scanning signals (gate driving signals) are transmitted via signal lines Lb1 to Lbm connected to a signal line driver 11 and a row scanning lines La1 to Lan connected to a gate line driver 12, respectively, to display an image, as shown in FIG. 17. At this time, to charge the signal line capacitor Csig and a row scanning line (gate line) capacitor Cg, powers given by the equations below are consumed, respectively:

$$Psig = Csig \times fsig \times Vsig^2$$

$$Pg = Cg \times fg \times Vg^2$$

Normally, fg<<fsig. Therefore, it is important to reduce a power consumption Psig in the signal line. To reduce the power consumption in the signal line, the capacitance Csig, the frequency fsig, and the voltage Vsig may be lowered. However, for a moving image, the rewrite frequency fsig as a frequency for giving the pixel signal cannot be zero, unlike for a still image. For a complex image, the driving power also increases.

More specifically, the LCD with pixel memories offers a technique which allows the lowering of the driving frequency fsig for a still image to obtain a large effect of reducing the dynamic power consumption. However, for moving image display, the driving frequency fsig must be raised, resulting in an increase in overall power consumption. When a moving image is to be displayed, the driving frequency fsig must be raised. However, the power consumption can be reduced by paying attention to the following characteristic feature of the moving image.

A TV signal or an image signal on a personal computer screen is characterized in that, in most scenes except scenes with quick motions or switching frames, the current frame signal includes a signal similar to the preceding frame signal. Therefore, in a normal image, the difference between the current frame signal and the preceding frame signal is almost zero.

Utilizing this characteristic feature, a pixel signal can be reproduced from the difference signal (about 0 [V]) to decrease the voltage amplitude Vsig necessary for charging/discharging the signal line capacitor Csig, so that the power consumption Psig in the signal line can be reduced. To reproduce the pixel signal, a signal of the immediately preceding frame is preserved in the pixel, and the preceding signal and the difference signal are added. With this processing, the current frame pixel signal can be constructed.

The apparatus for reconstructing the pixel signal from the difference signal may comprise a signal processor for comparing the current frame image signal with the preceding frame image signal and sending only the difference signal to the pixel, a memory for storing the preceding frame signal in the pixel, and an adder for adding the preceding frame signal and the difference signal.

To reduce the power consumption for a moving image, the 10the embodiment of the present invention provides a means for sending the difference signal between two frames as a pixel signal to lower the pixel signal voltage Vsig. A liquid crystal display apparatus which uses the first means for supplying the difference voltage between frames to the signal line, thereby to display an original image will be described.

In the 11the embodiment, a liquid crystal display apparatus which uses the second means, i.e., an integrator constituted in a pixel to display an original image using a pixel signal received as a difference signal will be described.

In the conventional signal line driving method, a desired voltage is output by a signal line driver to charge the signal line, and a voltage equal to the signal line driver output voltage is supplied to the pixel for which the gate of the corresponding sampling switch is turned on.

In the 11the embodiment, a means for controlling the pixel electrode potential by a current is provided. In this case, a pixel electrode potential Vpix is controlled by a current value Iin flowing into a pixel capacitor Cpix and the pixel electrode and a time t for which the current flows. That is, the pixel electrode potential Vpix is represented by equation (8) below:

$$Vpix=(Iin\times t)/Cpix \quad (8)$$

An output Vdrv from the signal line driver is determined by an ON resistance Ron of the TFT and the current value Iin. In the liquid crystal display panel, the capacitance value of the pixel memory of each pixel (liquid crystal cell) is about 1 [pF]. Since the charge amount necessary for driving the liquid crystal cell is small, a lower voltage than that for voltage driving suffices.

As the current-controlled arrangement, a TFT array structure incorporating an integrator for every pixel is provided. The charge amount of the integrator capacitor is controlled by the current, and the output potential from the integrator is applied to the pixel electrode. The pixel signal voltage Vsig applied to the signal line is given by equation (9) below:

$$Vsig=((Cf\times Ron)/Tgon)Vpix \quad (9)$$

where Tgon is the gate ON time, Ron is the ON resistance of the TFT, Cf is the integrator capacitance, and Vpix is the output from the integrator, i.e., the pixel voltage potential. When Cf=1 [pF], Ron=1 [MΩ], and Tgon=35 [μsec], the pixel signal voltage Vsig for giving Vsig=5 [V] is about 140 [mV]. This voltage value is 1/35 that of the conventional voltage-controlled scheme.

In a thin film transistor liquid crystal display apparatus (TFT-LCD) corresponding to a 10-inch VGA (640×480 pixels), the signal line capacitance Csig is about 100 [pF]. The power consumption is about 70 [mW] for the voltage-controlled scheme and about 601 [μW] for the current-controlled scheme, so that the power consumption can be largely reduced. The current-controlled scheme is can be effectively used for a large and high-definition screen for which the signal line capacitance increases.

(10th Embodiment)

Figure 18:
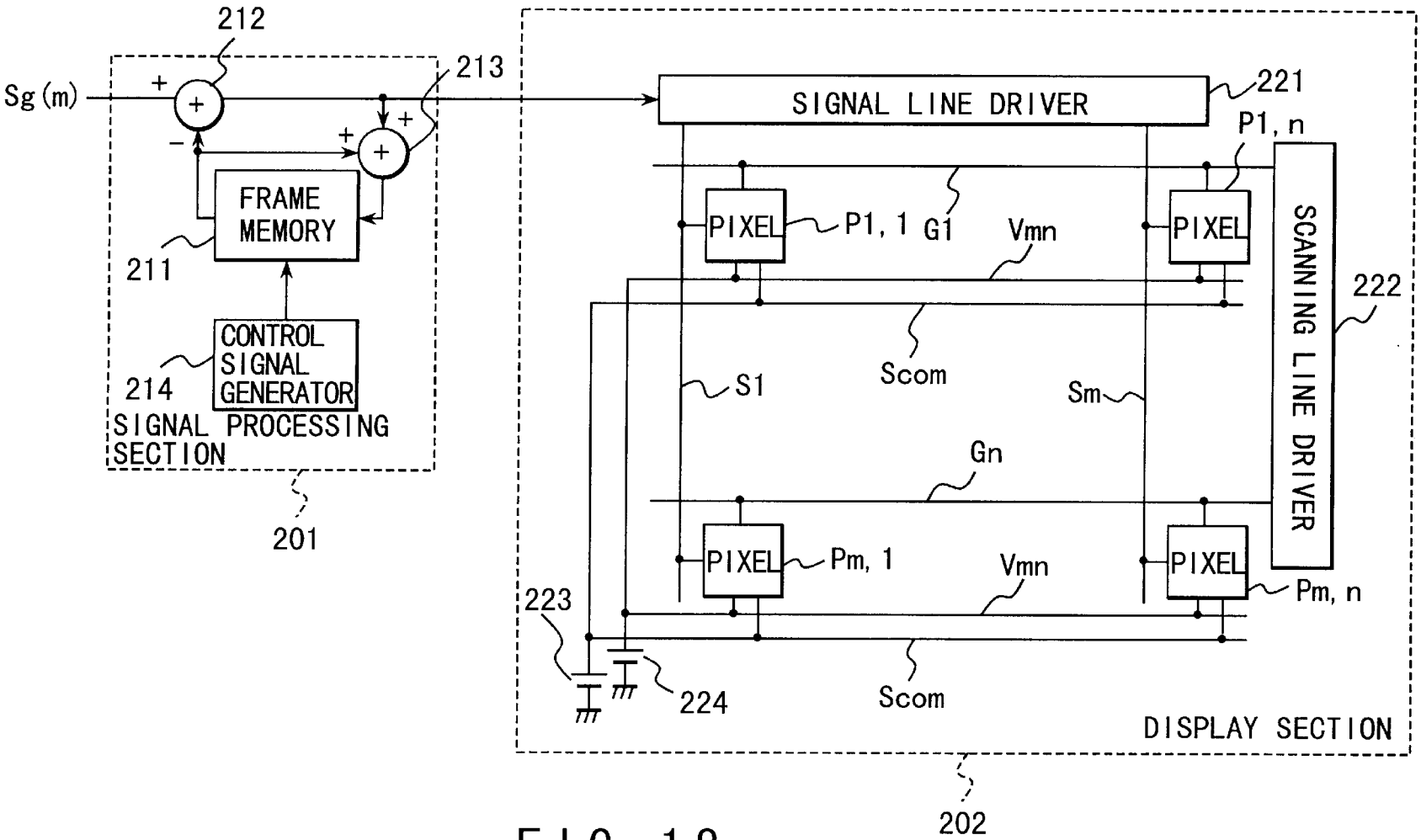
FIG. 18 is a block diagram of an image display apparatus according to the 10th embodiment of the present invention.

FIG. 18 is a block diagram of a liquid crystal display apparatus according to the 10th embodiment of the present invention. The liquid crystal display apparatus shown in FIG. 18 is constituted by a signal processing section 201 for comparing the current frame image signal with the preceding frame image signal and sending only the difference signal to the pixel (liquid crystal cell), and a display section 202.

The display section 202 is a liquid crystal display panel in which a plurality of pixels are arrayed in a matrix and has, in each of pixels P1,1 to Pm,n, a memory for storing the preceding frame signal, and an adder for adding the preceding frame signal and the difference signal. The signal processing section 201 is constituted by a frame memory 211, adders 212 and 213, and a control signal generator 214.

The display section 202 is constituted by the m×n pixels P1,1 to Pm,n, m signal lines S1 to Sm, n row scanning lines G1 to Gn, a common electrode Scom, a signal line driver 221, a scanning line driver 222, a common electrode power supply 223, and a bias power supply 224. The liquid crystal cell constituting the pixel in the liquid crystal di:3play panel has a structure in which a liquid crystal material is sandwiched between the common electrode and the pixel driving electrode. The electric field applied to the liquid crystal is changed by the voltage applied across the common electrode and the driving electrode, thus changing the transmissivity of the liquid crystal.

The common electrode power supply 223 is a power supply for supplying a voltage to be applied to the common electrode Scom. The signal line driver 221 is a circuit for driving the signal line to supply a pixel signal to a predetermined pixel. The signal line driver 221 receives the difference signal from the signal processing section 201 and distributes the difference signal to each pixel as a pixel signal. The scanning line driver 222 is a circuit for outputting a driving signal (gate driving signal) for row scanning.

Figure 19:
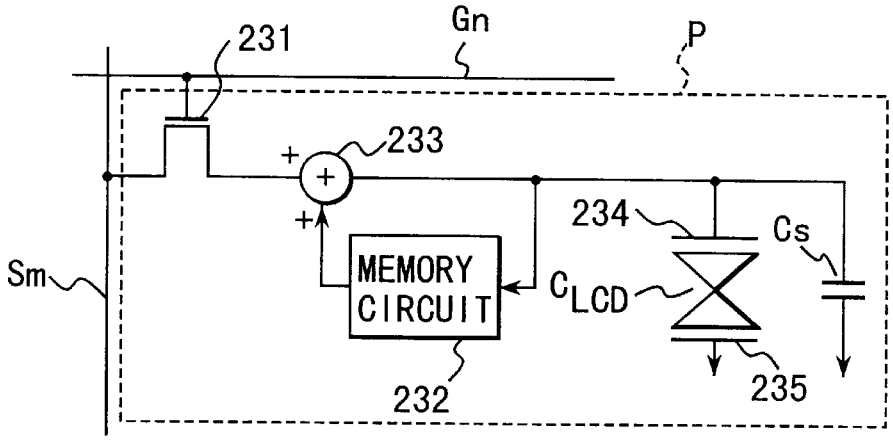
FIG. 19 is a circuit diagram showing the pixel arrangement of the 10th embodiment of the present invention.

Each of the pixels P1,1 to Pm,n is constituted by a TFT transistor 231 serving as a sampling switch, a memory 232 for storing and holding the pixel signal of the immediately preceding frame image, an adder 233 for adding the pixel signal held in the memory 232 and the current frame pixel signal, a pixel driving electrode 234 of a liquid crystal cell which receives the current frame image signal added and reconstructed by the adder 233, a common electrode 235 of the liquid crystal cells, a liquid crystal CLCD, and a storage capacitor Cs serving as the pixel memory of the liquid crystal cell, as shown in FIG. 19. The liquid crystal CLCD is the liquid crystal material sandwiched between the pixel driving electrode 234 and the common electrode 235.

When the gate driving signal is supplied to the row scanning line Gn, the TFT transistor 231 is turned on. The pixel signal sent to the signal line Sm is stored in the memory 232 through the TFT transistor 231 in the ON state. The adder 233 connected to the input side of the memory 232 adds the current difference signal (pixel signal) to the immediately preceding frame pixel signal held in the memory 232, and supplies the signal to the memory 232 and the storage capacitor Cs such that the memory 232 and the storage capacitor Cs hold the signal. The signal held in the storage capacitor Cs is supplied to the pixel driving electrode 234 and used to display an image. The memory 232 updates the memory image to the current image as the next frame pixel signal and stores/holds the image.

Figure 20:
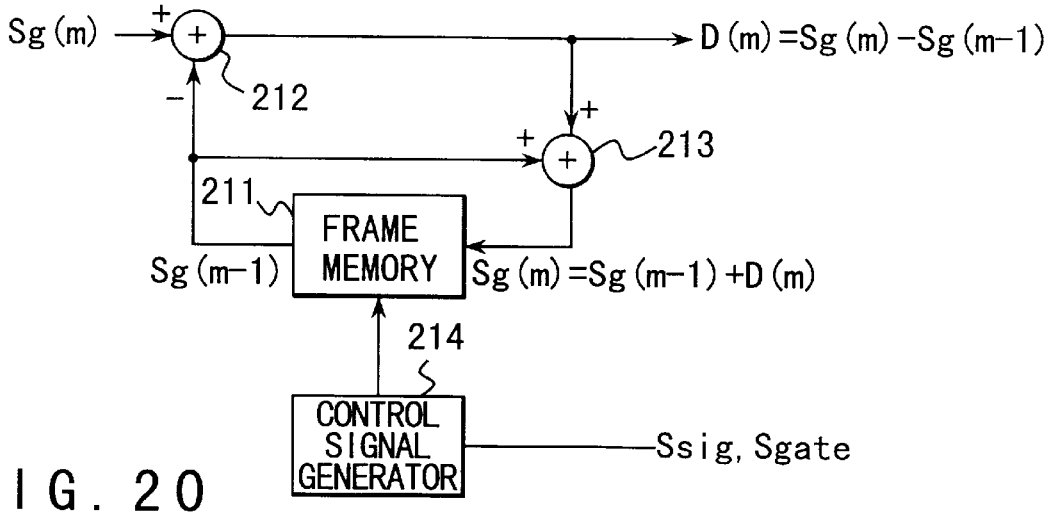
FIG. 20 is a block diagram showing the detailed arrangement of a signal processing section 201 in the 10th embodiment of the present invention.

The signal processing section 201 is constituted by the frame memory 211, the adders 212 and 213, and the control signal generator 214, as described above. FIG. 20 is a block diagram showing the detailed arrangement of the signal processing section 201. The frame memory 211 is a device for storing pixel signal data at an address which is designated in units of pixels, and stores data of the respective pixels of the immediately preceding frame. The adder 211 compares pixel signal data Sg(m) to be displayed with immediately preceding frame data Sg(m−1) output from the frame memory 211, and outputs a. difference signal D(m) between these data. The difference signal D(m) can be given by equation (10) below:

$$D(m)=Sg(m)-Sg(m-1) \quad (10)$$

The difference signal D(m) is output to the display section 202 and at the same time added to the immediately preceding frame pixel data Sg(m−1) by the adder 213 to reconstruct the current frame image signal Sg(m). The image signal Sg(m) is input to the frame memory 211. The reconstructed current frame image signal Sg(m) is stored at the address at which immediately preceding frame data Sg(m−1) to update the data.

The difference signal output D(m) from the signal processing section 201 is assumed to be a digital signal. Alternatively, A/D and D/A converters may be connected to the input and output of the frame memory 211 to form an analog input/output system.

The control signal generator 214 controls read/write access to the frame memory 211 and generates control signals (a start signal and a clock signal) Ssig and Sgate for the signal line driver 221 and the scanning line driver 222. The display section 202 receives the difference signal D(m) and the control signals Ssig and Sgate from the signal processing section 201 to display an image.

Figure 21:
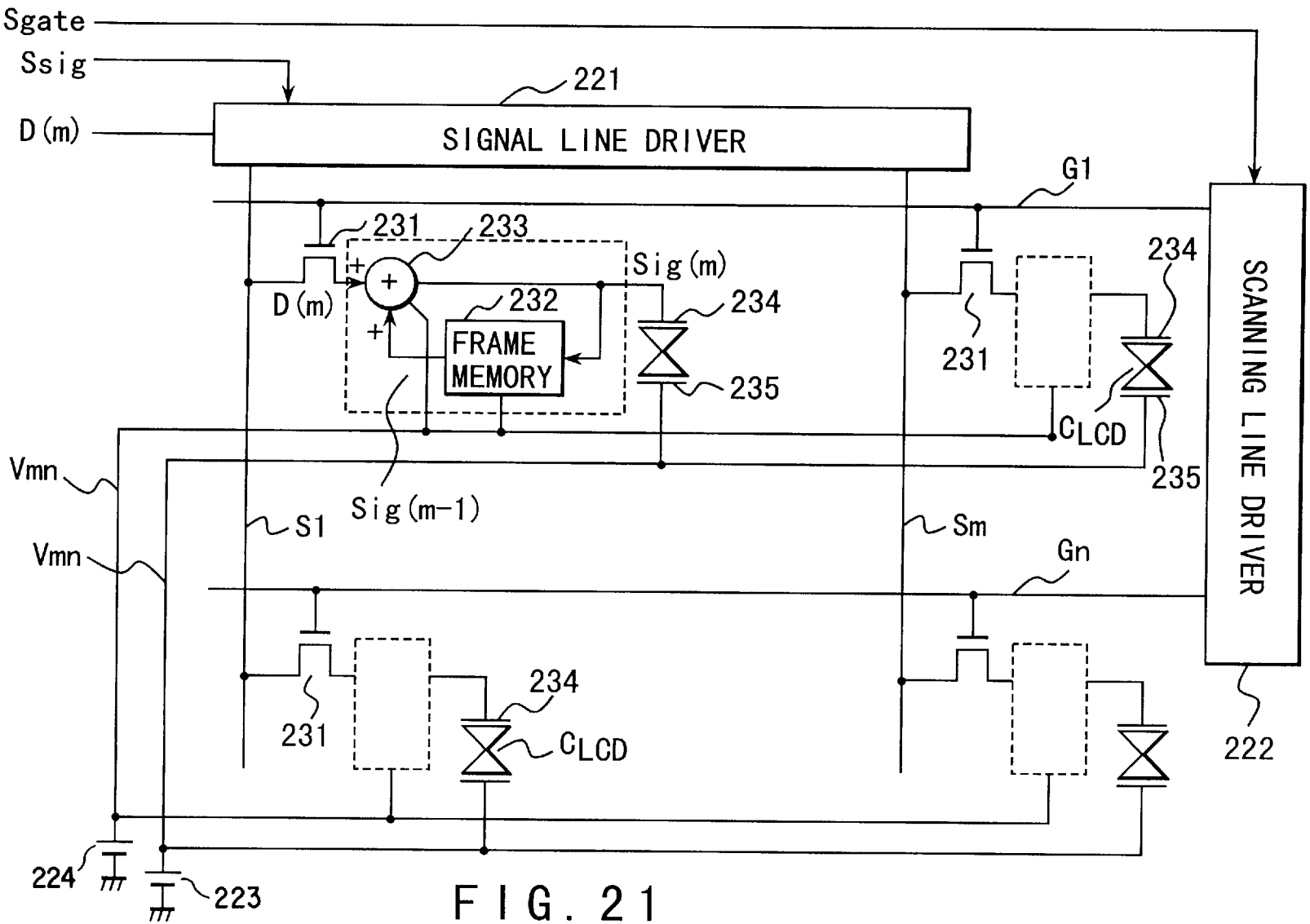
FIG. 21 is a block diagram showing the detailed arrangement of a display section 202 in the 10th embodiment of the present invention.

FIG. 21 is a block diagram showing the detailed arrangement of the display section 202. The signal line Sm is connected to the signal line driver 221. The source electrode of the TFT transistor 231 serving as a sampling switch is connected to the signal line Sm. The row scanning line Gn is connected to the scanning line driver 222. The gate electrode of the TFT transistor 231 is connected to the row scanning line Gn. The drain electrode of the TFT transistor 231 is connected to the memory 232 and the adder 233. The output terminal of the adder 233 is connected to the pixel electrode 234. The liquid crystal CLCD is encapsulated between the pixel electrode 234 and the common electrode 235.

The common electrode 235 is fixed at a common potential VCOM by the common electrode power supply 223. One electrode of the storage capacitor Cs is also fixed at the common potential VCOM. The power for the memory 232 and the adder 233 is supplied from the bias power supply 224 via a power supply line Vmn.

Figure 22A:
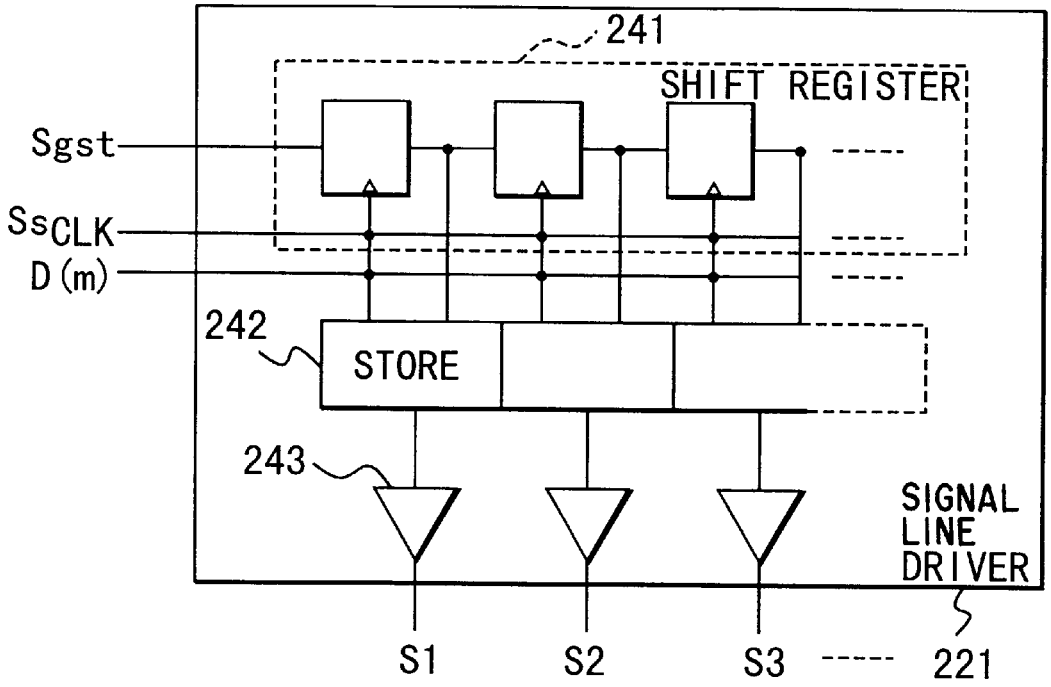
FIGS. 22A and 22B are block diagrams showing the circuit arrangements of a signal line driver 221 and a scanning line driver 222 in the 10th embodiment of the present invention, respectively.
Figure 22B:
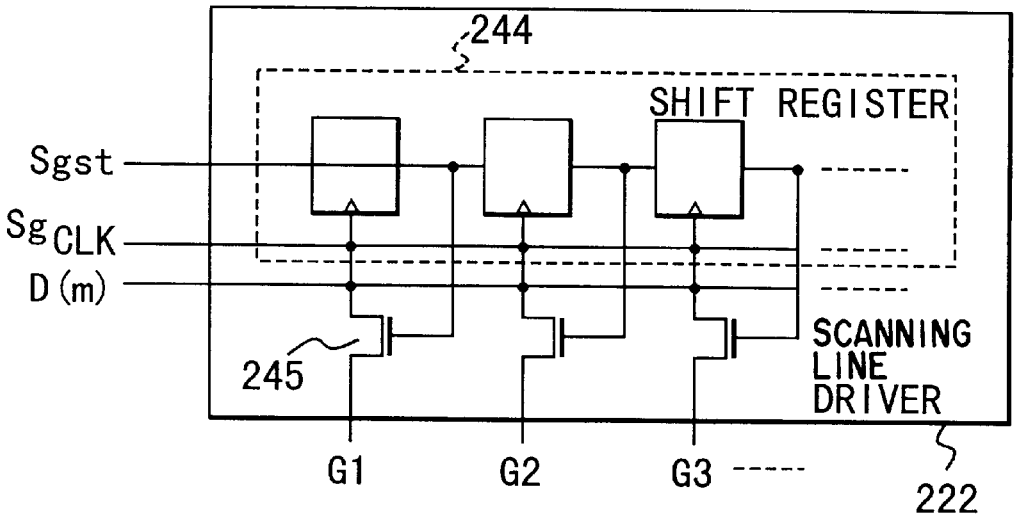

FIG. 22A is a block diagram showing the circuit arrangement of the signal line driver 221. FIG. 22B is a block diagram showing the circuit arrangement of the scanning line driver 222.

The signal line driver 221 receives the difference signal D(m) and the control signal Ssig from the signal processing section 201. A shift register 241 is operated by the control signal Ssig (a start signal Ssst synchronously output in units of frames and a clock signal Ssclk for defining a predetermined clock rate) to store the difference signal D(m) in a storage circuit 242. A signal converter 243 outputs a voltage corresponding to the value of the difference signal D(m) stored in the storage circuit 242 to charge the signal line Sm.

The gate line driver 222 is constituted by a shift register 244, and switches 245 which are turned on/off in accordance with outputs corresponding to the respective bit positions of the shift register 244. A predetermined voltage Vgg is applied from the power supply to the row scanning line Gn (n=1, 2, 3, . . . ) whose switch 245 is ON.

The gate line driver 222 receives the signal Sgate consisting of a start signal Sgst and a clock signal Sgclk supplied from the gate signal generator, inputs the start signal Sgst to the shift register 244, and operates the shift register 244 in accordance with the clock signal Sgclk, thereby operating each switch 245. The scanning line Gm connected to the switch 245 in the ON state is set at a high potential (voltage Vgg).

The TFT transistor 231 connected to the row scanning line at the high potential is turned on so that the signal D(m) in the signal line driver 221 is input to the adder 233 in a pixel P. The signal D(m) input to the adder 233 is added to the preceding frame signal Sg(m−1) stored in the memory 232 in advance, so that the current frame signal Sg(m) is reconstructed. That is, processing represented by equation (11) below is performed:

$$Sg(m)=Sg(m-1)+D(m) \tag{11}$$

The circuit constituted by the adder 233 and the memory 232 performs processing reverse to that of the signal processing section 201, so that the current frame signal Sg(m) is completely reconstructed. When the completely reconstructed current frame signal Sg(m) is supplied to the pixel driving electrode 234, the image can be displayed.

As described above, by supplying only the difference signal D(m) to the pixel, the image can be displayed. The voltage of the difference signal D(m) is almost 0V in a normal image, so the signal line Sm need rarely be charged/discharged. For this reason, the power consumed by the signal line Sm is reduced, and reduction of the power consumption can be realized.

(11th Embodiment)

Figure 23:
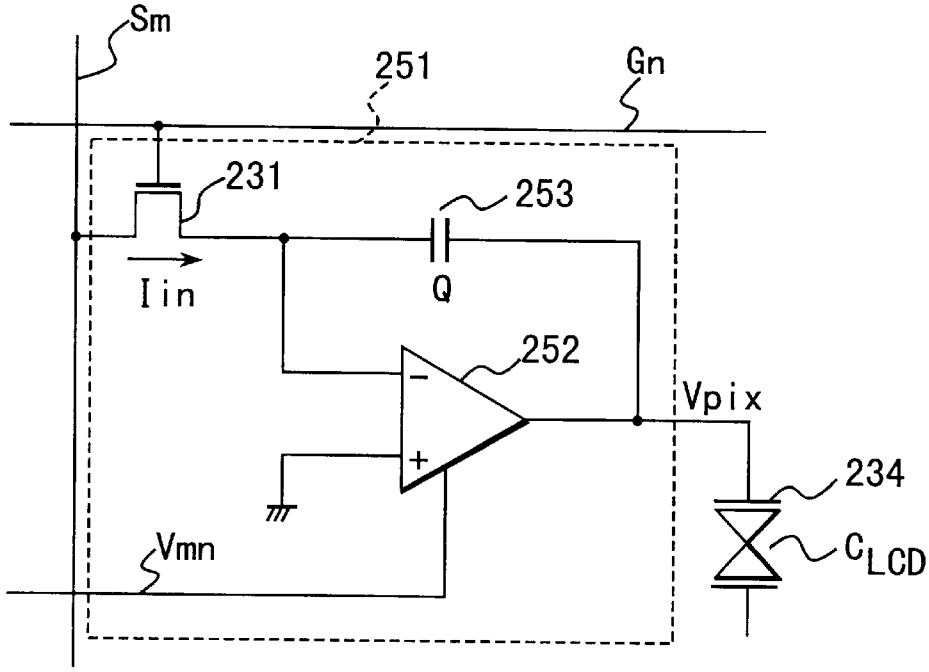
FIG. 23 is a circuit diagram showing the pixel arrangement of an image display apparatus according to the 11th embodiment of the present invention.

FIG. 23 is a block diagram showing the arrangement of a liquid crystal display apparatus according to the 11th embodiment of the present invention. The same reference numerals as in FIG. 18 denote the same parts in FIG. 23, and a detailed description thereof will be omitted.

In the liquid crystal display apparatus shown in FIG. 23, a pixel in a display section 202 incorporates an integrator 251 such that the pixel voltage is controlled by an amount of current flowing into the integrator 251.

As the specific example of the integrator 251, an arrangement including a TFT transistor 231, an operational amplifier 252, and a capacitor 253 is shown. The negative terminal of the operational amplifier 252 is connected to the drain electrode of the TFT transistor 231. The positive terminal of the operational amplifier 252 is connected to ground (grounded).

The capacitor 253 is inserted between the output terminal and the negative terminal of the operational amplifier 252, thereby forming a feedback loop. The output terminal of the operational amplifier 252 is connected to a pixel electrode 234 so that an output voltage from the operational amplifier 252 is supplied to the pixel electrode. A power is supplied to the operational amplifier 252 via a power supply line Vmn.

Figure 24:
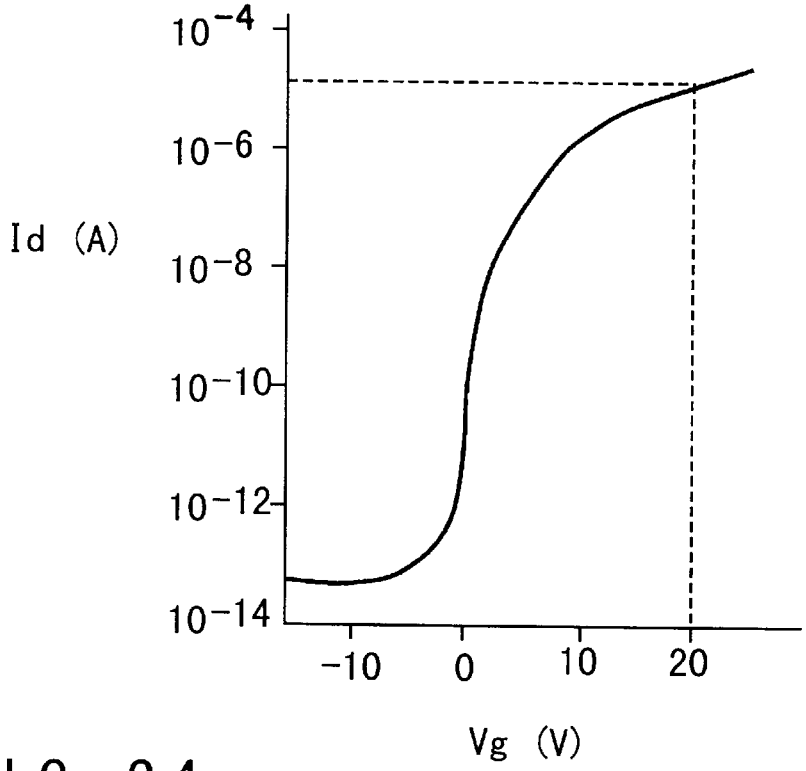
FIG. 24 is a graph showing the typical voltage vs. current (Vg-Id) characteristics of a TFT used in the present invention.

FIG. 24 shows the typical voltage vs. current (Vg-Id) characteristics of the TFT transistor 231 used as a sampling switch. To drive the TFT-LCD, normally, a gate voltage Vg is set to be about 20 [V] when the TFT transistor is ON, and about −5 [V] when the TFT transistor is OFF (source-drain voltage Vds=15 [V]).

When the TFT transistor is ON, a drain current Id is about $10^{-5}$ [A], and the TFT transistor can be regarded as a resistor having Ron of 1.5 [MΩ]. Therefore, the integrator 251 is constituted by the resistor (TFT transistor 231), the operational amplifier 252, and the capacitor 253.

The difference (Vsig−V(−); in this case, V(−)=0 [V]) between an output from a signal line driver 221 and the voltage at the negative terminal of the operational amplifier 252 is applied to the TFT transistor 231, so that a current Iin (=Vsig/Ron) flows.

An output Vpix (i.e., a pixel electrode potential) from the integrator 251 is determined by a charge amount Q accumulated in the capacitor 253 and a capacitance Cf of the capacitor. The charge amount Q is obtained by an ON time Tgon of the TFT transistor 231 and a current Im. The output Vpix of the integrator 251 is obtained in accordance with equation (12) below:

$$V\text{Pix}=(I\text{in}\times T\text{gon})/Cf \tag{12}$$

This driving scheme can be regarded as a current-controlled driving scheme. In this case, Tgon and Cf are determined by the design conditions of the TFT-LCD. For this reason, the output from the integrator 251 is controlled by the current Iin, i.e., the output Vsig from the signal line driver 221. When Vpix=5 [V], Cf=1 [pF], Ron=1.5 [MΩ], and Tgon=35 [$\mu$ sec], the following relation holds:

$$V\text{sig}=R\text{on}\times I\text{in}=214\ [\text{mV}]$$

As described above, when the integrator 251 is arranged in each pixel, and the pixel electrode potential is controlled by the value of the current flowing to the integrator 251, the voltage to be applied to the signal line can be lowered, and the power consumption in the signal line can be reduced.

The arrangement of the 11th embodiment can be applied to the 10th embodiment. More specifically, the integrator 251 is constituted by the memory 232 and the adder 233 in the 10th embodiment, and only the difference signal is supplied to the integrator 251. The integrator 251 stores the charges of the preceding frame signal in the capacitor 253. By adding only the difference signal, the current frame signal can be reconstructed.

(12th Embodiment)

Figure 25:
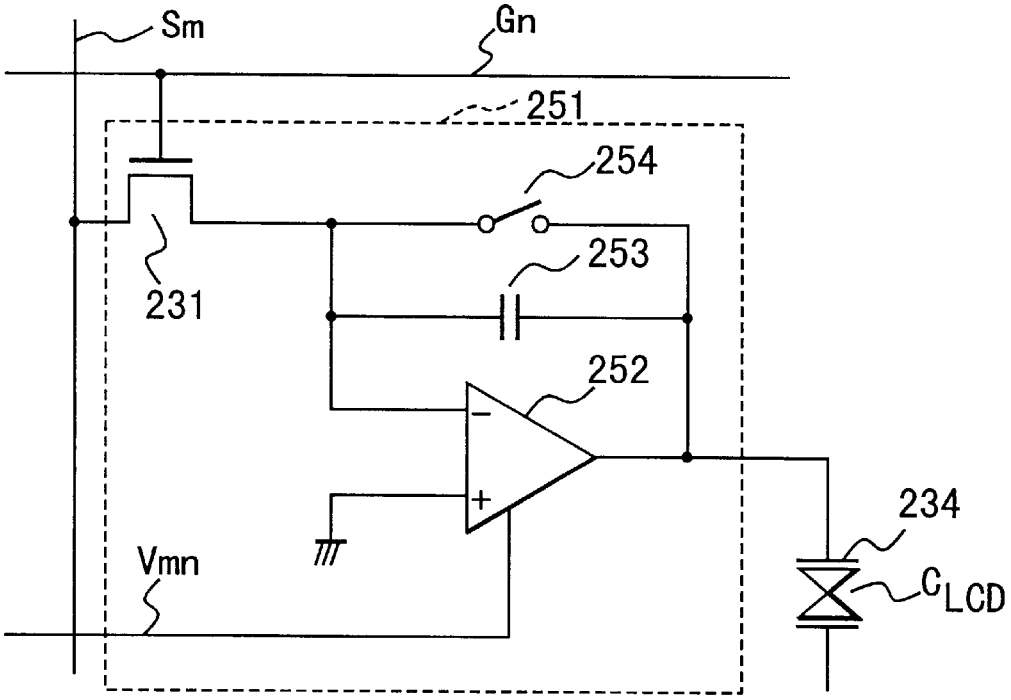
FIG. 25 is a circuit diagram showing the pixel arrangement of an image display apparatus according to the 12th embodiment of the present invention.

FIG. 25 is a block diagram showing the arrangement of a display section in a liquid crystal display apparatus according to the 12th embodiment of the present invention. The same reference numerals as in FIG. 18 denote the same parts in FIG. 25, and a detailed description thereof will be omitted.

The display section shown in FIG. 25 is characterized in that each pixel incorporates an integrator 251 such that the pixel voltage is controlled by an amount of current flowing into the integrator 251.

As the specific example of the integrator 251, an arrangement including a TFT transistor 231, an operational amplifier 252, a capacitor 253, and a switch 254 is shown in FIG. 25.

The gate of the TFT transistor 231 serving as a sampling switch is connected to a row scanning line Gn. The TFT transistor 231 is turned on upon receiving a row driving signal from the row scanning line Gn and receives a pixel signal from a signal line Sm via the source-drain path. The capacitor 253 is connected between the output terminal and the inverting input terminal of the operational amplifier 252. The noninverting terminal of the operational amplifier 252 is grounded. The switch 254 is connected in parallel to the capacitor 253. By closing the switch 254, the charges in the capacitor 253 can be removed. The operational amplifier 252 having a feedback circuit consisting of the capacitor 253 constitutes an integrator section. The TFT transistor 231 serves as a switch for receiving the pixel signal.

In this arrangement, an output from the operational amplifier 252 is applied to a liquid crystal cell driving electrode 234 to change the alignment of a liquid crystal CLCD, thus displaying an image in a corresponding gray level.

The basic operation of this embodiment is the same as that of the 11th embodiment. In this embodiment, the capacitor 253 and the switch 254 are connected to be parallel to each other. The switch 254 is short-circuited every predetermined period to remove the charges accumulated in the capacitor 253. With this operation, the charges of the preceding frame signal can be removed, and regular pixel signal charges can be accumulated in units of frames, so a signal free from errors can be displayed.

The method of this embodiment can be effectively applied to the 10th embodiment. More specifically, the switch 254 is closed at a predetermined rate (e.g., once per second) to supply a regular image signal, and a difference signal is supplied for the remaining periods. When only the difference signal is supplied, and an error is generated, the subsequent frame images are adversely affected permanently. To solve this problem, the regular image signals must be supplied at a predetermined rate. For this purpose, the arrangement of this embodiment can be effectively used.

In the above arrangement, the integrator has an analog circuit arrangement. An integrator having a digital arrangement will be described in the 13th embodiment below.

(13th Embodiment)

Figure 26:
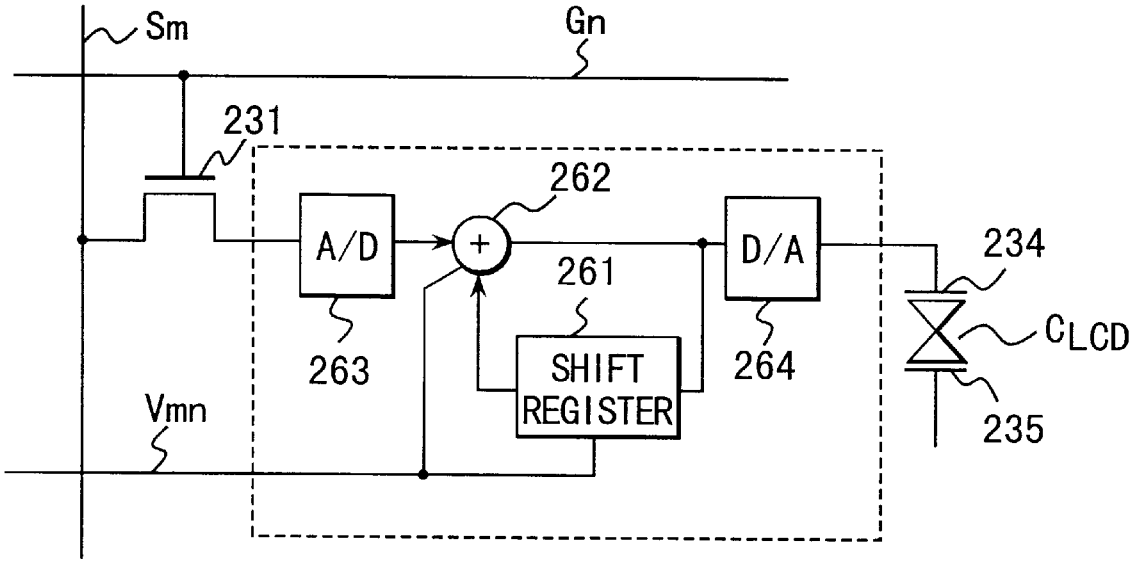
FIG. 26 is a circuit diagram showing the pixel arrangement of an image display apparatus according to the 13th embodiment of the present invention.

FIG. 26 is a block diagram of a pixel portion of a liquid crystal display apparatus according to the 13th embodiment of the present invention. In this embodiment, the integrator included in the pixel portion has a digital arrangement.

To digitize the integrator, a shift register 261 serving as a memory is used in place of the capacitor, an A/D converter 263 is inserted on the input side of an adder 262, and a D/A converter 264 is inserted on the output side of the adder 262.

The gate of a TFT transistor 231 is connected to a row scanning line Gn. The TFT transistor 231 is turned on upon receiving a row scanning line from the row scanning line Gn and receives a pixel signal from a signal line Sm through the source-drain path.

The A/D converter 263 converts the pixel signal into digital data and supplies the data to the adder 262. The adder 262 adds the pixel signal and the data held in the shift register 261 and supplies the sum data to the D/A converter 264. At this time, the sum data output from the adder 262 is also supplied to the shift register 261. The shift register 261 receives and holds this data.

The D/A converter 264 converts the sum data from the adder 262 into an analog signal and supplies the analog signal to a pixel driving electrode 234 of a corresponding liquid crystal cell. With this operation, the alignment of a liquid crystal CLCD is changed to display a gray-level image.

In the scheme used in this embodiment, a signal between frames of a moving image is sent as a difference signal. The immediately preceding signal is stored in the pixel, and the signal is added to the difference signal to reconstruct the current image. The shift register 261 holds the current image, and the image is shifted and supplied to the adder 262 when the next difference signal is to be received. With this processing, the immediately preceding frame image signal can be added to the difference signal of the current signal to reconstruct the current frame. In this case as well, the same effect as in the above embodiments is obtained.

As described above, according to the 10th to 13th embodiments, the active matrix display apparatus has the signal processor for comparing the current frame image signal with the immediately preceding frame image signal and sending only the difference signal to the pixel, and each pixel incorporates the memory for storing the preceding frame signal, and the adder for adding the preceding signal and the difference signal. Alternatively, each pixel incorporates an integrator so that the pixel signal to be supplied to the signal line is sent as the difference signal between the current frame and the preceding frame. This difference signal is added to the preceding frame signal to reconstruct a signal corresponding to the pixel of the current frame image. This signal is supplied to the liquid crystal cell to drive the liquid crystal cell.

When the difference signal between the current frame and the preceding frame is supplied to the signal line, the signal amplitude is almost 0 [V] for most moving images except scenes with quick motions and switching frames. For this reason, when the pixel signal is supplied as a voltage signal, the amplitude of the voltage signal can be largely decreased. Even when the pixel electrode potential is controlled by a current, the signal line driving voltage can be lowered.

Conventionally, the signal line is driven at an amplitude of 5 [V]. In difference signal driving or current-controlled driving, the image can be displayed at an amplitude as small as several hundred [mV]. The power consumption is proportional to the square of the voltage. For this reason, in difference signal driving or current-controlled driving, the power consumed in the signal line can be largely reduced to one-several tenth or one-several hundredth.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A liquid crystal display apparatus comprising:

a substrate;

a plurality of scanning lines extending substantially in parallel with each other in a row direction on said substrate;

a plurality of signal lines extending substantially in parallel with each other in a column direction on said substrate;

a signal line driver for supplying a current signal as a pixel signal to each of said plurality of signal lines;

a scanning line driver for selectively supplying a scanning signal to said plurality of scanning lines; and a plurality of pixels arranged on said substrate at intersections of said plurality of scanning lines and said plurality of signal lines, each of said plurality of pixels including conversion circuit for receiving the current signal, which is supplied to said signal lines, and converting the current signal into a voltage signal, and a liquid crystal cell to which the converted voltage signal is applied.

2. An apparatus according to claim 1, wherein said conversion circuit includes one of a capacitor and a resistor.

3. An apparatus according to claim 1, wherein said pixel further comprises a first switch inserted between said conversion circuit and a corresponding one of said plurality of signal lines and ON/OFF-controlled in accordance with the scanning signal of a corresponding one of said plurality of scanning lines.

4. An apparatus according to claim 1, wherein said pixel further comprises a second switch inserted between said conversion circuit and said liquid crystal cell, and a driving period of said liquid crystal cell is determined by ON/OFF of said second switch.

5. An apparatus according to claim 1, wherein said signal line driver receives a digital voltage image signal and outputs the current signal under a predetermined voltage.

6. An apparatus according to claim 5, wherein an output stage of said signal line driver is constituted by an operational amplifier.

7. An apparatus according to claim 1, wherein said signal line driver receives a first current signal as an image signal and outputs a second current signal as the pixel signal.

8. An apparatus according to claim 1, wherein a voltage amplitude of said pixel signal supplied from said signal line driver is substantially zero.

9. A liquid crystal display apparatus comprising:

a substrate;

a plurality of scanning lines extending substantially in parallel with each other in a row direction on said substrate;

a plurality of control lines extending substantially in parallel with each other in the row direction on said substrate and paired with said plurality of scanning lines, respectively;

a plurality of signal lines extending substantially in parallel with each other in a column direction on said substrate;

a signal line driver for supplying a current signal as a pixel signal to each of said plurality of signal lines;

a scanning line driver for selectively supplying a scanning signal to said plurality of scanning lines; and a plurality of pixels arranged on said substrate at intersections of said plurality of scanning lines and said plurality of signal lines, each of said plurality of pixels including:

a first switch having a first conduction path and a first control terminal controlling a conduction state of the first conduction path, one end of the first conduction path being connected to a corresponding one of the plurality of the signal lines, and the first control terminal being connected to a corresponding one of the plurality of scanning lines;

one of a resistor and a capacitor, one end of which is connected to the other end of said conduction path of said first switch and the other end of which is connected to a first fixed potential;

a second switch having a second conduction path and a second control terminal controlling a conduction state of said second conduction path, one end of said second conduction path being connected to the other end of said first conduction path of said first switch, and said second control terminal being connected to a corresponding one of said plurality of control lines; and a liquid crystal cell having two electrodes, one of said two electrodes being connected to the other end of said second conduction path of said second switch, and the other of said two electrodes being connected to a second fixed potential.

10. A liquid crystal display apparatus comprising:

a substrate;

a plurality of scanning lines extending substantially in parallel with each other in a row direction on said substrate;

a plurality of signal lines extending substantially in parallel with each other in a column direction on said substrate;

a signal line driver for supplying a current signal as a pixel signal to each of said plurality of signal lines;

a scanning line driver for selectively supplying a scanning signal to said plurality of scanning lines; and a plurality of pixels arranged on said substrate at intersections of said plurality of scanning lines and said plurality of signal lines, each of said plurality of pixels including conversion means for receiving the current signal, which is supplied to said signal lines, and converting the current signal into a voltage signal, and a liquid crystal cell to which the converted voltage signal is applied, wherein said signal line driver comprises:

n (n is an integer) resistors, one of the ends of said n resistors receiving n input bit signals, respectively, and the other ends of said n resistors being connected with each other to form a node; and an operational amplifier, an inverting input terminal of said operational amplifier being connected to the node, a noninverting input terminal of said operational amplifier being grounded, and an output terminal of said operational amplifier being connected to the inverting terminal thereof and outputting the current signal to a corresponding one of said plurality of signal lines.

* * * * *